US009618865B2

(12) United States Patent
Sugiura et al.

(10) Patent No.: US 9,618,865 B2
(45) Date of Patent: Apr. 11, 2017

(54) TONER, IMAGE FORMING APPARATUS, PROCESS CARTRIDGE, AND DEVELOPER

(71) Applicants: Hideki Sugiura, Shizuoka (JP); Mio Kumai, Shizuoka (JP)

(72) Inventors: Hideki Sugiura, Shizuoka (JP); Mio Kumai, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/771,309

(22) PCT Filed: Mar. 13, 2014

(86) PCT No.: PCT/JP2014/057640

§ 371 (c)(1),
(2) Date: Aug. 28, 2015

(87) PCT Pub. No.: WO2014/142352

PCT Pub. Date: Sep. 18, 2014

(65) Prior Publication Data

US 2016/0004178 A1 Jan. 7, 2016

(30) Foreign Application Priority Data

Mar. 15, 2013 (JP) ..... 2013-054299

(51) Int. Cl.
*G03G 9/093* (2006.01)
*G03G 9/087* (2006.01)
*G03G 9/08* (2006.01)

(52) U.S. Cl.
CPC ..... *G03G 9/08755* (2013.01); *G03G 9/0806* (2013.01); *G03G 9/0821* (2013.01); *G03G 9/0825* (2013.01); *G03G 9/0827* (2013.01); *G03G 9/08764* (2013.01); *G03G 9/08795* (2013.01); *G03G 9/08797* (2013.01); *G03G 9/09357* (2013.01); *G03G 9/09371* (2013.01)

(58) Field of Classification Search
CPC ..... G03G 9/08755; G03G 9/08764; G03G 9/08797; G03G 9/09371; G03G 9/09357
USPC ..... 430/123.53
See application file for complete search history.

(56) References Cited

U.S. PATENT DOCUMENTS

| | | | | |
|---|---|---|---|---|
| 5,968,701 | A * | 10/1999 | Onuma | G03G 9/0821 430/108.22 |
| 6,503,676 | B2 | 1/2003 | Yamashita et al. | |
| 7,024,140 | B2 | 4/2006 | Masuda et al. | |
| 7,166,403 | B2 | 1/2007 | Ichikawa et al. | |
| 7,169,525 | B2 | 1/2007 | Sugiura et al. | |
| 7,172,844 | B2 | 2/2007 | Umemura et al. | |
| 7,232,632 | B2 | 6/2007 | Kondou et al. | |
| 7,258,959 | B2 | 8/2007 | Nakayama et al. | |
| 7,261,989 | B2 | 8/2007 | Sugiura et al. | |
| 7,318,989 | B2 | 1/2008 | Kotsugai et al. | |
| 7,323,281 | B2 | 1/2008 | Emoto et al. | |
| 7,374,851 | B2 | 5/2008 | Nakayama et al. | |
| 7,405,000 | B2 | 7/2008 | Takikawa et al. | |
| 7,455,942 | B2 | 11/2008 | Nagatomo et al. | |
| 7,759,036 | B2 | 7/2010 | Utsumi et al. | |
| 8,007,976 | B2 | 8/2011 | Sugiura et al. | |
| 8,043,780 | B2 | 10/2011 | Sugiura et al. | |
| 2002/0136973 | A1 | 9/2002 | Sugiura et al. | |
| 2002/0155366 | A1 | 10/2002 | Mochizuki et al. | |
| 2002/0160290 | A1 | 10/2002 | Sugiura et al. | |
| 2002/0182526 | A1 | 12/2002 | Masuda et al. | |
| 2003/0031946 | A1 | 2/2003 | Sugiura et al. | |
| 2003/0152857 | A1 | 8/2003 | Sugiura et al. | |
| 2003/0186154 | A1 | 10/2003 | Suzuki et al. | |
| 2003/0190543 | A1 | 10/2003 | Sugiura et al. | |
| 2003/0232266 | A1 | 12/2003 | Sugiura et al. | |
| 2004/0058260 | A1 | 3/2004 | Katoh et al. | |
| 2004/0067189 | A1 | 4/2004 | Sugiura et al. | |
| 2004/0072091 | A1 | 4/2004 | Mochizuki et al. | |
| 2004/0115550 | A1 | 6/2004 | Sugiura et al. | |
| 2005/0026064 | A1 | 2/2005 | Sugiura et al. | |
| 2005/0089786 | A1 | 4/2005 | Sugiura et al. | |
| 2005/0089787 | A1 | 4/2005 | Uchinokura et al. | |
| 2005/0191575 | A1 | 9/2005 | Sugiura et al. | |
| 2005/0208408 | A1 | 9/2005 | Uchinokura et al. | |
| 2005/0260516 | A1 * | 11/2005 | Tomita | G03G 9/0804 430/110.3 |
| 2006/0024600 | A1 | 2/2006 | Sugiura | |
| 2006/0024604 | A1 | 2/2006 | Sugiura et al. | |
| 2007/0059063 | A1 | 3/2007 | Nakayama et al. | |
| 2007/0140748 | A1 | 6/2007 | Sugiura | |
| 2007/0275318 | A1 | 11/2007 | Sugiura et al. | |
| 2008/0014527 | A1 | 1/2008 | Kotsugai et al. | |
| 2008/0268366 | A1 | 10/2008 | Nakayama et al. | |
| 2009/0023092 | A1 | 1/2009 | Sugiura | |

(Continued)

FOREIGN PATENT DOCUMENTS

| | | |
|---|---|---|
| JP | 04-024702 | 4/1992 |
| JP | 2002-162773 | 6/2002 |
| JP | 2003-207925 | 7/2003 |
| JP | 2009-222997 | 10/2009 |
| JP | 2010-160451 | 7/2010 |
| JP | 2011-185973 | 9/2011 |
| JP | 2013-050570 | 3/2013 |
| JP | 2014-052571 | 3/2014 |
| RU | 2 454 691 | 6/2012 |
| WO | WO 2012/011546 | 1/2012 |
| WO | WO2014/038644 A1 | 3/2014 |

OTHER PUBLICATIONS

International Search Report Issued Apr. 15, 2014 for counterpart International Patent Application No. PCT/JP2014/057640 filed Mar. 13, 2014.

Russian Office Action issued Jan. 24, 2017, in corresponding Russian Patent Application No. 201514399/04 (067793), (with English-language Translation).

*Primary Examiner* — Christopher Rodee
(74) *Attorney, Agent, or Firm* — Oblon, McClelland, Maier & Neustadt, L.L.P.

(57) ABSTRACT

A toner, including: a colorant; and a binder resin, wherein a spreadability of the toner under a non-pressurized condition is 1.20 to 2.50, wherein a common logarithm of a storage modulus at 100° C. (G') of the toner is 4.0 [log Pa] to 5.0 [log Pa], and wherein a ratio of a loss modulus at 100° C. (G") to the storage modulus at 100° C. (G') of the toner (G"/G'=tan δ) is 1.1 to 2.2.

19 Claims, 2 Drawing Sheets

(56) References Cited

U.S. PATENT DOCUMENTS

| | | | | |
|---|---|---|---|---|
| 2009/0196658 | A1 | 8/2009 | Sugiura | |
| 2009/0220883 | A1 | 9/2009 | Sugiura | |
| 2009/0233217 | A1 | 9/2009 | Hasegawa | |
| 2010/0028795 | A1 | 2/2010 | Magome et al. | |
| 2010/0316948 | A1 | 12/2010 | Sakaguchi et al. | |
| 2011/0003244 | A1 | 1/2011 | Inoue et al. | |
| 2011/0097659 | A1 | 4/2011 | Sugiura et al. | |
| 2011/0281209 | A1 | 11/2011 | Sugiura et al. | |
| 2011/0294064 | A1 | 12/2011 | Miyaake et al. | |
| 2012/0231387 | A1 | 9/2012 | Sugiura | |
| 2012/0237868 | A1* | 9/2012 | Yamada ..... | G03G 9/0821 430/108.21 |
| 2013/0130169 | A1 | 5/2013 | Aoki et al. | |
| 2013/0236828 | A1 | 9/2013 | Mizoguchi et al. | |
| 2013/0244169 | A1 | 9/2013 | Miyaake et al. | |
| 2013/0260297 | A1 | 10/2013 | Sugiura | |
| 2015/0355563 | A1 | 12/2015 | Aoki et al. | |

* cited by examiner

TONER, IMAGE FORMING APPARATUS, PROCESS CARTRIDGE, AND DEVELOPER

TECHNICAL FIELD

One embodiment of the present invention relates to a toner, an image forming apparatus, a process cartridge, and a developer.

BACKGROUND ART

In an image forming apparatus such as an electrophotographic device and an electrostatic recording device, an image is formed by developing with a toner an electrostatic latent image formed on a photoconductor to form a toner image, transferring the toner image to a recording medium such as paper, and then fixing the toner image with an application of heat. To form a full-color image, typically four colors of toners, i.e., black, yellow, magenta, and cyan are used for developing, and toner images of these colors are transferred and superimposed on the recording medium, followed by fixing at once with an application of heat.

A toner having low temperature fixability has been demanded for the purpose of lowering global environmental loads.

Therefore, it has been known to use a crystalline resin as a binder resin of a toner (see PTL 1).

CITATION LIST

Patent Literature

PTL 1 Japanese Patent Application Publication (JP-B) No. 04-24702

SUMMARY OF INVENTION

Technical Problem

However, conventional technologies cannot achieve a toner having all of low temperature fixability under a low temperature and low humidity environment, flowability under a high temperature and high humidity environment, paper type correspondency, and dot reproducibility.

One embodiment of the present invention has been made in view of the above existing problem, and aims to provide a toner which is excellent in low temperature fixability under a low temperature and low humidity environment, flowability under a high temperature and high humidity environment, paper type correspondency, and dot reproducibility.

Solution to Problem

One embodiment of the present invention is as follows.

A toner, including:

a colorant; and a binder resin, wherein spreadability under a non-pressurized condition is 1.20 to 2.50, wherein a common logarithm of a storage modulus (G') at 0.100° C. is 4.0 [log Pa] to 5.0 [log Pa], and wherein a ratio of a loss modulus (G") at 100° C. to the storage modulus (G') at 100° C. (G"/G'=tan δ) is 1.1 to 2.2.

Advantageous Effects of Invention

According to the present invention, a toner which is excellent in low temperature fixability under a low temperature and low humidity environment, flowability under a high temperature and high humidity environment, paper type correspondency, and dot reproducibility can be provided.

DESCRIPTION OF EMBODIMENTS

Figure 1:
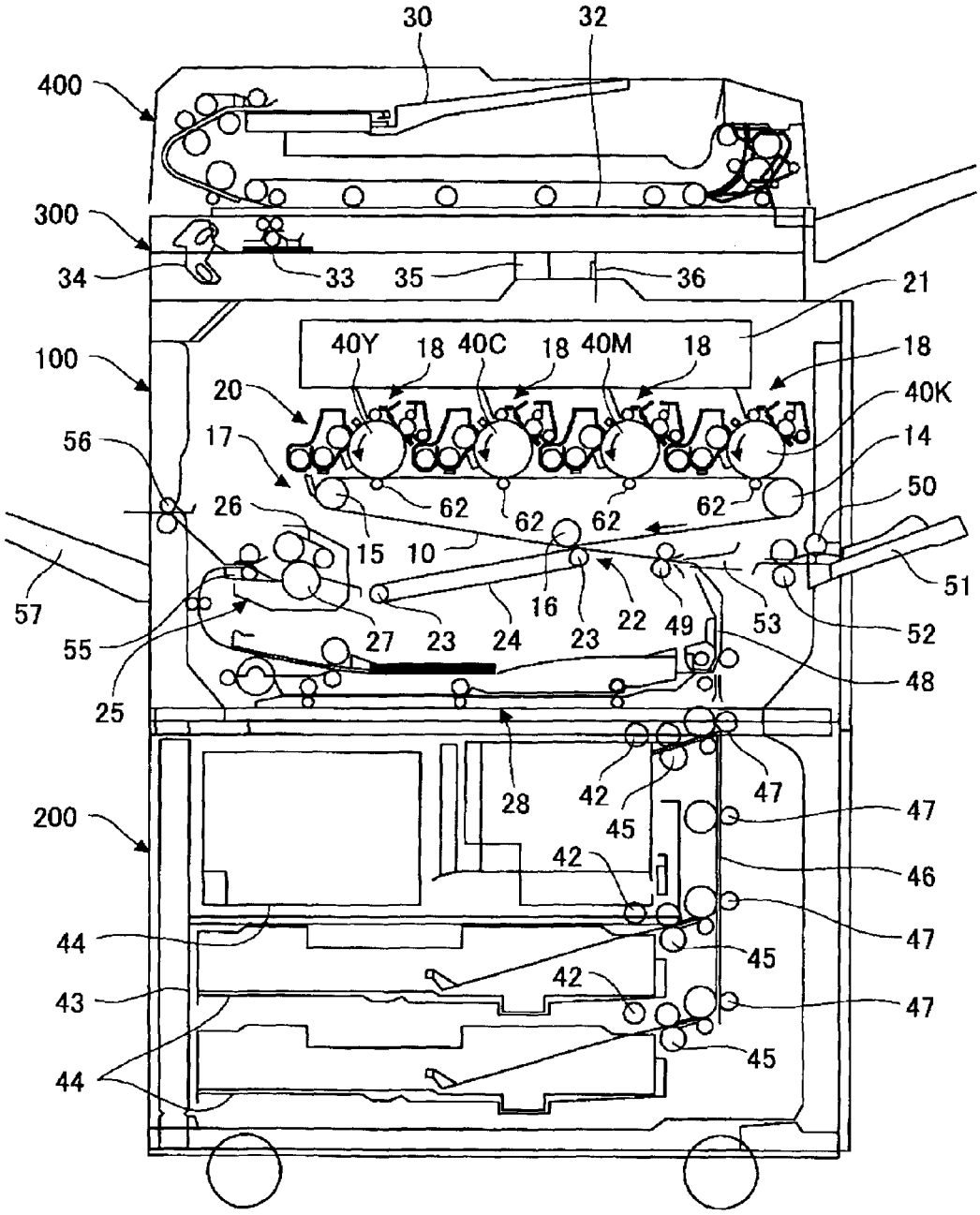
FIG. 1 is a schematic diagram illustrating one example of an image forming apparatus.

Embodiments of the present invention now will be described with reference to figures.

(Toner)

A toner contains a colorant and a binder resin.

The toner has spreadability under a non-pressurized condition of 1.20 to 2.50, preferable 1.30 to 2.20. When the spreadability under a non-pressurized condition of the toner is less than 1.20, the toner is insufficiently melt-spreaded with heating, so that adhesion force to a recording medium is decreased at a region with which a fixing member is less likely to contact (e.g., depression of paper) to thereby cause cold-offset. As a result, paper type correspondency is deteriorated. Meanwhile, when the spreadability under a non-pressurized condition of the toner is more than 2.50, the toner is excessively decreased in melt-viscosity, so that blurring due to melting is caused during fixing, potentially leading to deteriorated fine dot reproducibility.

Note that, the spreadability under a non-pressurized condition of the toner means an average value of ratios of particle areas at 100° C. to particle areas at 25° C. when the toner is heated from 25° C. to 100° C. at a rate of 10° C./min.

The toner has a common logarithm of a storage modulus (G') at 100° C. [log G'] of 4.0 [log Pa] to 5.0 [log Pa], preferably 4.8 [log Pa] to 5.0 [log Pa], which allows melt-spreading of the toner to be appropriately controlled at a region with which a fixing member is appropriately contacted under a pressure. When the log G' is less than 4.0 [log Pa], the toner is excessively lowered in an elastic modulus, which deteriorates flowability under a high temperature and high humidity environment. When the log G' is more than 5.0 [log Pa], the toner is excessively elevated in the elastic modulus, which deteriorates low temperature fixability under a low temperature and low humidity environment.

The toner has a ratio of a loss modulus (G") at 100° C. to the storage modulus (G') at 100° C. (G"/G'=tan δ) of 1.1 to 2.2, preferably 1.1 to 1.5, which allows melt-spreading of the toner to be appropriately controlled at a region with which a fixing member is appropriately contacted under a pressure. When the tan δ is less than 1.1, the toner is excessively elevated in the elastic modulus, which deteriorates the low temperature fixability under a low temperature and low humidity environment. When the tan δ is more than 2.2, the toner is excessively lowered in the elastic modulus, which deteriorates the flowability under a high temperature and high humidity environment.

Note that, the storage modulus and the loss modulus of the toner means a storage modulus and a loss modulus of a toner which has been pressure-molded into a tablet having a diameter of 10 mm and a thickness of 1 mm.

The toner is preferably produced through granulation in a medium containing water and/or an organic solvent from the viewpoint of controlling a crystal structure thereof.

An amount of ethyl acetate contained in the toner is preferably 1 μg/g to 30 μg/g, further preferably 5 μg/g to 17 μg/g, which can improve the low temperature fixability under a low temperature and low humidity environment of the toner. Note that, the amount of the ethyl acetate contained in the toner is typically 30 μg/g or less. When the amount of the ethyl acetate contained in the toner is more than 30 μg/g, developing stability may be deteriorated.

Note that, the amount of the ethyl acetate contained in the toner can be measured by means of GC-MS.

The toner has the degree of crystallinity of typically 10% or more, preferably 20% or more, further preferably 30% or more, making it easy to ensure a sharp melting property of the toner.

Note that, the degree of crystallinity of the toner can be determined by X-ray crystal diffractometry.

<Binder Resin>

The binder resin preferably contains a crystalline resin.

An amount of the crystalline resin contained in the binder resin is typically 10% by mass or more, preferably 20% by mass or more, further preferably 30% by mass or more.

The binder resin may further contain a non-crystalline resin, but an amount of the crystalline resin contained in the binder resin is preferably 50% by mass or more.

A crystalline material is defined as a material in which atoms or molecules are aligned in a spatially repeated pattern, and which exhibits a diffraction pattern by a common X-ray diffractometer.

The crystalline resin is not particularly limited as long as it has crystallinity. Examples thereof include polyester, polyurethane, polyurea, polyamide, polyether, a vinyl resin, and a modified crystalline resin. These may be used in combination. Among them, preferable are polyester, polyurethane, polyurea, polyamide, and polyether, further preferable is a resin having a urethane backbone and/or a urea backbone, and particularly preferable are a linear polyester and a composite resin containing a linear polyester.

Examples of the resin having a urethane backbone and/or a urea backbone include polyurethane, polyurea, a urethane-modified polyester, and a urea-modified polyester.

The urethane-modified polyester can be synthesized by allowing a polyol to react with a terminal isocyanate group-containing polyester.

The urea-modified polyester can be synthesized by allowing amines to react with a terminal isocyanate group-containing polyester.

The crystalline resin has the maximum peak temperature of heat of fusion of typically 45° C. to 70° C., preferably 53° C. to 65° C., further preferably 58° C. to 62° C. When the maximum peak temperature of heat of fusion is lower than 45° C., the toner may be deteriorated in heat resistant storability. When the maximum peak temperature of heat of fusion is higher than 70° C., the toner may be deteriorated in the low temperature fixability.

An amount of a crystalline polyester contained in the binder resin is typically 10% by mass or more, preferably 20% by mass or more.

The crystalline polyester has a melting point of typically 45° C. to 70° C., preferably 53° C. to 65° C., further preferably 58° C. to 62° C. When the melting point of the crystalline polyester is lower than 45° C., the toner may be deteriorated in the heat resistant storability. When the melting point of the crystalline polyester is higher than 70° C., the toner may be deteriorated in the low temperature fixability.

Note that, the melting point of the crystalline polyester is a peak temperature of an endothermic peak determined by differential scanning calorimetry (DSC).

The crystalline polyester includes a copolymer of a polyester component with other components, in addition to a polymer all of which components has a polyester structure. However, in the former case, a rate of the other components contained in the copolymer is 50% by mass or less.

The crystalline polyester can be synthesized through polycondensation of a polyvalent carboxylic acid with a polyhydric alcohol.

Examples of the polyvalent carboxylic acid include a divalent carboxylic acid and a trivalent or higher carboxylic acid.

The divalent carboxylic acid is not particularly limited. Examples thereof include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids, such as dibasic acid (e.g., phthalic acid, isophthalic acid, terephthalic acid, naphthalene-2,6-dicarboxylic acid, malonic acid, and mesaconic acid).

The trivalent or higher carboxylic acid is not particularly limited. Examples thereof include 1,2,4-benzenetricarboxylic acid, 1,2,5-benzenetricarboxylic acid, and 1,2,4-naphthalenetricarboxylic acid. These may be used in combination.

Note that, instead of the polyvalent carboxylic acid, anhydrides or lower alkyl esters of the polyvalent carboxylic acid may be used.

The polyvalent carboxylic acid may include a sulfonate group-containing dicarboxylic acid, or a double bond-containing dicarboxylic acid.

The polyhydric alcohol preferably includes an aliphatic diol, further preferably a linear aliphatic diol having 7 to 20 carbon atoms in its main chain. In the case of a branched aliphatic diol, the polyester is decreased in crystallinity, which may lower a melting point thereof. When the number of carbon atoms in the main chain is less than 7, the resultant polyester is increased in a melting temperature in the case where the aliphatic diol is polycondensated with an aromatic dicarboxylic acid, potentially leading to a deteriorated low temperature fixability. When the number of carbon atoms in the main chain is greater than 20, it is practically difficult to obtain a raw material. The number of carbon atoms in the main chain is further preferably 14 or less.

The aliphatic diols is not particularly limited. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, 1,8-octanediol, 1,9-nonanediol, and 1,10-decanediol are preferable in view of availability.

The polyhydric alcohol may further contain a trihydric or higher alcohol.

The trihydric or higher alcohol is not particularly limited. Examples thereof include glycerin, trimethylol ethane, trimethylol propane, and pentaerythritol. These may be used in combination.

An amount of the aliphatic diol contained in the polyhydric alcohol is typically 80 mol % or more, preferably 90 mol % or more. When the amount of the aliphatic diol contained in the polyhydric alcohol is less than 80 mol %, the polyester is decreased in crystallinity, and thus the melting temperature, which may deteriorate blocking resistance of the toner, image storability, and low temperature fixability.

For the purpose of adjusting an acid value or a hydroxyl value, the polycarboxylic acid or the polyhydric alcohol may be added at the final stage of synthesis.

The polyvalent carboxylic acid to be added at the final stage of synthesis is not particularly limited. Examples thereof include an aromatic carboxylic acid, such as terephthalic acid, isophthalic acid, phthalic anhydride, trimellitic anhydride, pyromellitic acid, and naphthalene dicarboxylic acid; an aliphatic carboxylic acid, such as maleic anhydride, fumaric acid, succinic acid, alkenyl succinic anhydride, and adipic acid; and an alicyclic carboxylic acid, such as cyclohexane dicarboxylic acid.

The polyhydric alcohol to be added at the final stage of synthesis is not particularly limited. Examples thereof include an aliphatic diol, such as ethylene glycol, diethylene glycol, triethylene glycol, propylene glycol, butanediol, hexanediol, and neopentyl glycol; an alicyclic diol, such as cyclohexanediol, cyclohexane dimethanol, and hydrogenated bisphenol A; and an aromatic diol, such as bisphenol A ethylene oxide adduct, and bisphenol A propylene oxide adduct.

The crystalline polyester can be typically synthesized at a temperature of 180° C. to 230° C., if necessary, with water or alcohol generated during polycondensation being removed by reducing a pressure in a system.

In the case where the polyvalent carboxylic acid and the polyhydric alcohol are not dissolved or compatibilized at the temperature upon synthesis, an organic solvent having a high boiling point may be added as a solubilizing agent to thereby dissolve them. In this case, polycondensation is performed with the organic solvent being distilled off.

In synthesis of a copolymer, in the case where there is a polymerizable monomer having poor compatibility, the polymerizable monomer having poor compatibility may be condensed with the polyvalent carboxylic acid or the polyhydric alcohol in advance, and the resultant may be polycondensed.

A catalyst capable of being used in synthesis of the polyester is not particularly limited and may be appropriately selected depending on the intended purpose. Examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyltriphenyl phosphonium bromide, triethylamine, and triphenyl amine.

The crystalline polyester has typically an acid value of 3.0 mgKOH/g to 30.0 mgKOH/g, preferably 6.0 mgKOH/g to 25.0 mgKOH/g, further preferably 8.0 mgKOH/g to 20.0 mgKOH/g. When the acid value is lower than 3.0 mgKOH/g, the crystalline polyester is decreased in dispersibility into water, potentially making it difficult to form particles by a wet process. When the acid value is greater than 30.0 mgKOH/g, the toner is increased in moisture absorbability, and therefore the toner may be susceptible to an environment.

The crystalline polyester has typically a weight average molecular weight of 6,000 to 35,000. When the weight average molecular weight is less than 6,000, the toner penetrates into a recording medium (e.g., paper) during fixing, leading to uneven fixing. In addition, a fixed image may be deteriorated in bending resistance. When the weight average molecular weight is greater than 35,000, the toner may be deteriorated in low temperature fixability.

Note that, the weight average molecular weight of the crystalline polyester means a molecular weight in terms of polystyrene as measured by gel permeation chromatography (GPC).

The crystalline resin preferably contains 50% by mass or more of a crystalline aliphatic polyester synthesized from an aliphatic polyvalent carboxylic acid and an aliphatic polyhydric alcohol.

An amount of components derived from the aliphatic polyvalent carboxylic acid and the aliphatic polyhydric alcohol contained in the crystalline aliphatic polyester is typically 60 mol % or more, preferably 90 mol % or more.

A non-crystalline polyester is not particularly limited. Examples thereof include a urea-modified polyester and a non-modified polyester. These may be used in combination.

The urea-modified polyester can be synthesized by allowing amines to react with an isocyanate group-containing polyester prepolymer.

A period for which the amines are allowed to react with the isocyanate group-containing polyester prepolymer is typically 10 min to 40 hours, preferably 2 hours to 24 hours.

A temperature at which the amines are allowed to react with the isocyanate group-containing polyester prepolymer is typically 0° C. to 150° C., preferably 40° C. to 98° C.

Upon reaction of the amines with the isocyanate group-containing polyester prepolymer, a catalyst such as dibutyl tin laurate and dioctyl tin laurate may be used, if necessary.

The isocyanate group-containing polyester prepolymer can be synthesized by allowing a polyisocyanate to react with a hydroxyl group-containing polyester at 40° C. to 140° C.

The hydroxyl group-containing polyester can be synthesized by polycondensating a polyol with a polycarboxylic acid in the presence of a catalyst (e.g., tetrabutoxy titanate and dibutyl tin oxide) at 150° C. to 280° C., if necessary, with generated water being distilled off under a reduced pressure.

The polyol is preferably a diol, or a mixture of a diol and a small amount of a trihydric or higher polyol.

The diol is not particularly limited. Examples thereof include alkylene glycol (e.g., ethylene glycol, 1,2-propylene glycol, 1,3-propylene glycol, 1,4-butanediol, and 1,6-hexanediol); alkylene ether glycol (e.g., diethylene glycol, triethylene glycol, dipropylene glycol, polyethylene glycol, polypropylene glycol, and polytetramethylene ether glycol); alicyclic diol (e.g., 1,4-cyclohexanedimethanol, and hydrogenated bisphenol A); bisphenols (e.g., bisphenol A, bisphenol F, and bisphenol S); alkylene oxide (e.g., ethylene oxide, propylene oxide, and butylene oxide) adduct of the alicyclic diol; and alkylene oxide (e.g., ethylene oxide, propylene oxide, and butylene oxide) adduct of the bisphenols. Among them, preferable are C2-C12 alkylene glycol, and the alkylene oxide adduct of bisphenols; more preferable are the alkylene oxide adduct of bisphenols, or a combination of the alkylene oxide adduct of bisphenols with the C2-C12 alkylene glycol.

The trihydric or higher polyol is not particularly limited. Examples thereof include trihydric or higher aliphatic alcohols (e.g., glycerin, trimethylol ethane, trimethylol propane, pentaerythritol, and sorbitol), trihydric or higher phenols (e.g., trisphenol PA, phenol novolak, and cresol novolak); and alkylene oxide adduct of the trihydric or higher polyphenols.

The polycarboxylic acid is preferably a dicarboxylic acid alone, or a mixture of a dicarboxylic acid with a small amount of a trivalent or higher polycarboxylic acid.

The dicarboxylic acid is not particularly limited. Examples thereof include alkylene dicarboxylic acid (e.g., succinic acid, adipic acid, and sebacic acid), alkenylene dicarboxylic acid (e.g., maleic acid, and fumaric acid), and aromatic dicarboxylic acid (e.g., phthalic acid, isophthalic acid, terephthalic acid, and naphthalene dicarboxylic acid). Among them, preferred are C4-C20 alkenylene dicarboxylic acid, and C8-C20 aromatic dicarboxylic acid.

The trivalent or higher polycarboxylic acid is not particularly limited. Examples thereof include C9-C20 aromatic polycarboxylic acid (e.g., trimellitic acid, and pyromellitic acid).

Note that, instead of the polycarboxylic acid, acid anhydrides or lower alkyl esters (e.g., methyl ester, ethyl ester, or isopropyl ester) of the polycarboxylic acid may be used.

Upon polycondensation of the polyol with the polycarboxylic acid, a molar ratio of a hydroxyl group of the polyol to a carboxyl group of the polycarboxylic acid ([OH]/[COOH]) is typically 1 to 2, preferably 1 to 1.5, further preferably 1.02 to 1.3.

The polyisocyanate is not particularly limited. Examples thereof include aliphatic polyisocyanate (e.g., tetramethylene diisocyanate, hexamethylene diisocyanate, and 2,6-diisocyanate methyl caproate), alicyclic polyisocyanate (e.g., isophorone diisocyanate, and cyclohexylmethane diisocyanate), aromatic diisocyanate (e.g., tolylene diisocyanate, and diphenyl methane diisocyanate), aromatic aliphatic diisocyanate (e.g., α,α,α',α'-tetramethyl xylylene diisocyanate), and isocyanurates. These may be used in combination.

Note that, instead of the polyisocyanate, the foregoing polyisocyanates blocked with phenol derivatives, oxime or caprolactam may be used.

Upon reaction of the polyisocyanate with the hydroxyl group-containing polyester, a molar ratio of an isocyanate group of the polyisocyanate to a hydroxyl group of the hydroxyl group-containing polyester ([NCO]/[OH]) is typically 1 to 5, preferably 1.2 to 4, further preferably 1.5 to 2.5. When the [NCO]/[OH] is less than 1, the toner may be deteriorated in hot-offset resistance. When the [NCO]/[OH] is more than 5, the toner may be deteriorated in low temperature fixability.

An amount of a component derived from the polyisocyanate contained in the isocyanate group-containing polyester prepolymer is typically 0.5% by mass to 40% by mass, preferably 1% by mass to 30% by mass, further preferably 2% by mass to 20% by mass. When the amount of a component derived from the polyisocyanate contained in the isocyanate group-containing polyester prepolymer is less than 0.5% by mass, the toner may be deteriorated in hot-offset resistance. When the amount is more than 40% by mass, the toner may be deteriorated in low temperature fixability.

An average value of the number of the isocyanate group contained in the isocyanate group-containing polyester prepolymer is typically 1 or more, preferably 1.5 to 3, further preferably 1.8 to 2.5. When the average value of the number of the isocyanate group contained in the isocyanate group-containing polyester prepolymer is less than 1, the toner may be deteriorated in hot-offset resistance.

The amines are not particularly limited. Examples thereof include a diamine, a trivalent or higher polyamine, an amino alcohol, an aminomercaptan, and an amino acid. Among them, preferable is a diamine, or a mixture of a diamine with a small amount of trivalent or higher polyamine.

Examples of the diamine include aromatic diamine (e.g., phenylene diamine, diethyl toluene diamine, and 4,4'-diaminodiphenyl methane); alicyclic diamine (e.g., 4,4'-diamino-3,3'-dimethyldichlorohexyl methane, diamine cyclohexane, and isophorone diamine); and aliphatic diamine (e.g., ethylene diamine, tetramethylene diamine, and hexamethylene diamine).

Examples of the trivalent or higher polyamine include diethylene triamine, and triethylene tetramine.

Examples of the amino alcohol include ethanol amine, and hydroxyethyl aniline.

Examples of the aminomercaptan include aminoethylmercaptan, and aminopropylmercaptan.

Examples of the amino acid include amino propionic acid, and amino caproic acid.

Note that, instead of the amines, a blocked amine in which an amino group is blocked may be used.

The blocked amine is not particularly limited. Examples thereof include ketimine and oxazoline obtained from the amines and a ketone (e.g., acetone, methyl ethyl ketone and methyl isobutyl ketone).

Upon reaction of the amines with the isocyanate group-containing polyester prepolymer, if necessary, the urea-modified polyester can be adjusted to have a desired molecular weight using a terminator.

The terminator is not particularly limited. Example thereof includes a monoamine (e.g., diethyl amine, dibutyl amine, butyl amine, and lauryl amine).

Note that, instead of the monoamine, a blocked monoamine in which an amino group is blocked (e.g., ketimine) may be used.

Upon reaction of the amines with the isocyanate group-containing polyester prepolymer, a molar ratio of an isocyanate group of the isocyanate group-containing polyester prepolymer to an amino group of the amines ([NCO]/[NHx]) is typically 1/2 to 2, preferably 2/3 to 3/2, further preferably 5/6 to 6/5. When the [NCO]/[NHx] is less than 1/2 or more than 2, the toner may be deteriorated in hot-offset resistance.

The binder resin preferably contains the urea-modified polyester and the non-modified polyester, which can improve low temperature fixability of the toner, and glossiness and uniformity of glossiness of a full-color image.

The non-modified polyester can be synthesized by polycondensating the polyol with the polycarboxylic acid which are the same as in the urea-modified polyester.

The urea-modified polyester is at least partially compatible with the non-modified polyester from the viewpoints of low temperature fixability and hot-offset resistance of the toner. Therefore, the polyol and the polycarboxylic acid which constitute the non-modified polyester have preferably a similar composition to that of the urea-modified polyester.

A mass ratio of the urea-modified polyester to the non-modified polyester is typically 5/95 to 75/25, preferably 10/90 to 25/75, further preferably 12/88 to 25/75, particularly preferably 12/88 to 22/78. When the mass ratio of the urea-modified polyester to the non-modified polyester is less than 5/95, the toner may be deteriorated in hot-offset resistance. When the mass ratio is more than 75/25, the toner may be deteriorated in low temperature fixability.

The non-modified polyester has typically a peak molecular weight of 1,000 to 30,000, preferably 1,500 to 10,000, more preferably 2,000 to 8,000. When the peak molecular weight of the non-modified polyester is less than 1,000, the toner may be deteriorated in hot-offset resistance. When the peak molecular weight is more than 10,000, the toner may be deteriorated in low temperature fixability.

The non-modified polyester has typically the hydroxyl value of 5 mgKOH/g or more, preferably 10 mgKOH/g to 120 mgKOH/g, further preferably 20 mgKOH/g to 80 mgKOH/g. When the hydroxyl value of the non-modified polyester is less than 5 mgKOH/g, the toner may be difficult to achieve both of heat resistant storability and low temperature fixability.

The non-modified polyester has typically the acid value of 0.5 mgKOH/g to 40 mgKOH/g, preferably 5 mgKOH/g to 35 mgKOH/g. When the acid value of the non-modified polyester is less than 0.5 mgKOH/g, the toner may be less likely to be negatively charged. When the acid value is more than 40 mgKOH/g, the toner is susceptible to an environment under high temperature and high humidity or under low temperature and low humidity, leading to image deterioration.

The binder resin may further contain the urethane-modified polyester.

The toner contains toner base particles each containing the colorant and the binder resin. Each of the toner base particles preferably has a core-shell structure.

Note that, the core-shell structure can be confirmed by a transmission electron microscope. In the core-shell structure, surfaces of the toner base particles are covered with a contrast component which is different from a component which is in inside of the toner base particles.

The shell has typically a thickness of 50 nm or more.

The shell preferably contains a vinyl-based resin.

A resin constituting the shell has typically a glass transition point of 40° C. to 100° C. When the glass transition point of the resin constituting the shell is less than 40° C., the toner may be deteriorated in heat resistant storability. When the glass transition point is more than 100° C., the toner may be deteriorated in low temperature fixability.

The resin constituting the shell has typically a weight average molecular weight of 3,000 to 300,000. When the weight average molecular weight of the resin constituting the shell is less than 3,000, the toner may be deteriorated in heat resistant storability. When the weight average molecular weight is more than 300,000, the toner may be deteriorated in low temperature fixability.

A residual rate of the shell relative to the toner base particles is typically 0.5% by mass to 5.0% by mass. When the residual rate of the shell relative to the toner base particles is less than 0.5% by mass, the toner may be deteriorated in heat resistant storability. When the residual rate of the shell is more than 5.0% by mass, the toner may be deteriorated in low temperature fixability.

The residual rate of the shell relative to the toner base particles can be calculated from a peak area of a substance, which is not derived from the toner base particles but is derived from the shell, determined by means of a pyrolysis gas chromatograph-mass spectrometer.

The resin constituting the shell is not particularly limited as long as it is dispersible into an aqueous medium. Examples thereof include a vinyl-based resin, polylactic acid, polyurethane, an epoxy resin, polyester, polyamide, polyimide, a silicon-based resin, a phenolic resin, a melamine resin, a urea resin, an aniline resin, an ionomer resin, and polycarbonate. These may be used in combination. Among them, the vinyl-based resin is preferable because fine spherical dispersion can be easily obtained.

The vinyl-based resin is not particularly limited as long as it is a homopolymer or copolymer of a vinyl-based monomer. Examples thereof include a styrene-(meth)acrylic acid ester resin, a styrene-butadiene copolymer, a (meth)acrylic acid-acrylic acid ester polymer, a styrene-acrylonitrile copolymer, a styrene-maleic anhydride copolymer, a styrene-(meth)acrylic acid copolymer, a homopolymer of styrene or substituted product thereof (e.g., polystyrene, poly-p-chlorostyrene, and polyvinyl toluene), a styrene-based copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer), polymethyl methacrylate, and polybutyl methacrylate.

<Colorant>

The colorant is not particularly limited as long as it is a dye or a pigment. Examples thereof include carbon black, a nigrosin dye, iron black, Naphthol Yellow S, Hansa Yellow (10G, 5G and G), Cadmium Yellow, Yellow Iron Oxide, Yellow Ocher, Yellow Lead, Titanium Yellow, Polyazo Yellow, Oil Yellow, Hansa Yellow (GR, A, RN and R), Pigment Yellow L, Benzidine Yellow (G and GR), Permanent Yellow (NCG), Vulcan Fast Yellow (5G, R), Tartrazine lake, Quinoline Yellow Lake, Anthrasan Yellow BGL, Isoindolinone Yellow, Colcothar, Red Lead, Lead Vermilion, Cadmium Red, Cadmium Mercury Red, Antimony Vermilion, Permanent Red 4R, Para Red, Fiser Red, Para Chloro Ortho Nitro Aniline Red, Lithol Fast Scarlet G, Brilliant Fast Scarlet, Brilliant Carmine BS, Permanent Red (F2R, F4R, FRL, FRLL And F4RH), Fast Scarlet VD, Vulcan Fast Rubin B, Brilliant Scarlet G, Lithol Rubin GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, Polyazo Red, Chrome Vermilion, Benzidine Orange, Perinone Orange, Oil Orange, Cobalt Blue, Cerulean Blue, Alkali Blue Lake, Peacock Blue Lake, Victoria Blue Lake, Metal-Free Phthalocyanine Blue, Phthalocyanine Blue, Fast Sky Blue, Indanthrene Blue (RS And BC), Indigo, Ultramarine, Iron Blue, Anthraquinone Blue, Fast Violet B, Methyl Violet Lake, Cobalt Purple, Manganese Violet, Dioxane Violet, Anthraquinone Violet, Chrome Green, Zinc Green, Chromium Oxide, Viridian, Emerald Green, Pigment Green B, Naphthol Green B, Green Gold, Acid Green Lake, Malachite Green Lake, Phthalocyanine Green, Anthraquinone Green, Titanium. Oxide, Zinc Flower, and Lithopone. These may be used in combination.

An amount of the colorant contained in the toner is typically 1% by mass to 15% by mass, preferably 3% by mass to 10% by mass.

The pigment may be used as a master batch in which the colorant forms a composite with a resin.

Examples of the resin include a urea-modified polyester, a non-modified polyester resin, a polymer of styrene or substituted product thereof (e.g., polystyrene, poly-p-chlorostyrene, and polyvinyl toluene), a styrene-based copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer), polymethyl methacrylate, polybutyl methacrylate, polyvinyl chloride, polyvinyl acetate, polyethylene, polypropylene, polyester, an epoxy resin, an epoxy polyol resin, polyurethane, polyamide, polyvinyl butyral, a polyacrylic acid resin, rosin, modified rosin, a terpene resin, an aliphatic or alicyclic hydrocarbon resin, an aromatic petroleum resin. These may be used in combination.

The master batch can be prepared by mixing and kneading the pigment and the resin with an application of shear force. In the mixing and kneading, an organic solvent may be used in order to enhance interactions between the pigment and the resin. Moreover, the master batch is preferably prepared by a flushing method in which an aqueous paste containing the pigment is mixed and kneaded with the resin and the organic solvent to thereby transfer the pigment to the resin, followed by removing water and the organic solvent, because, in the flushing method, a wet cake of the pigment can be used as it is without being dried.

In the mixing and kneading of the pigment and the resin with an application of shear force, a high-shearing disperser (e.g., a three-roll mill) can be used.

<Other Components>

The toner may further contain a releasing agent, a charge controlling agent, a flowability improving agent, and a cleanability improving agent.

—Releasing Agent—

The releasing agent is not particularly limited. Examples thereof include a polyolefin wax (e.g., polyethylene wax, and polypropylene wax), a long-chain hydrocarbon (e.g., paraffin wax, and Sasol wax), and a carbonyl group-containing wax. Among them, preferable is the carbonyl group-containing wax.

Examples of the carbonyl group-containing wax include polyalkanoic acid ester (e.g., carnauba wax, montan wax, trimethylol propane tribehenate, pentaerythritol tetrabehenate, pentaerythritol diacetate dibehenate, glycerin tribehenate, and 1,18-octadecanediol distearate); polyalkanol ester (e.g., tristearyl trimellitate, and distearyl maleate); polyalkanoic acid amide (e.g., ethylene diamine dibehenyl amide); polyalkyl amide (e.g., tristearyl amide trimellitate); and dialkyl ketone (e.g., distearyl ketone). Among them, preferable is polyalkanoic acid ester.

The releasing agent has typically a melting point of 40° C. to 160° C., preferably 50° C. to 120° C., further preferably 60° C. to 90° C. When the melting point of the releasing agent is less than 40° C., the toner may be deteriorated in heat resistant storability. When the melting point of the releasing agent is more than 160° C., the toner may be deteriorated in low temperature fixability.

A melt viscosity at a temperature 20° C. higher than the melting point of the releasing point is typically 5 cps to 1,000 cps, preferably 10 cps to 100 cps. When the melt viscosity at a temperature 20° C. higher than the melting point of the releasing point is more than 1,000 cps, the toner may be deteriorated in hot-offset resistance and low temperature fixability.

An amount of the releasing agent contained in the toner is typically 0% by mass to 40% by mass, preferably 3% by mass to 30% by mass.

—Charge Controlling Agent—

The charge controlling agent is not particularly limited. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorosurfactants, metal salts of salicylic acid, metal salts of salicylic acid derivatives, copper phthalocyanine, perylene, quinacridone, azo pigment, and polymer compounds containing a group such as a sulfonate group, a carboxyl group, or a quaternary ammonium base.

Examples of commercially available products of the charge controlling agent include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenolic condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Hoechst AG); LRA-901, and boron complex LR-147 (manufactured by Japan Carlit Co., Ltd.).

A mass ratio of the charge controlling agent to the binder resin is typically 0.001 to 0.1, preferably 0.002 to 0.05. When the mass ratio is greater than 0.1, the toner is excessively increased in chargeability, which increases electrostatic attractive force with a developing roller. As a result, flowability of a developer, or image density may be deteriorated.

The charge controlling agent may be used as a masterbatch similar to the pigment.

—Flowability Improving Agent—

The flowability improving agent is not particularly limited. Examples thereof include silica particles, alumina particles, titania particles, barium titanate particles, magnesium titanate particles, calcium titanate particles, strontium titanate particles, iron oxide particles, copper oxide particles, zinc oxide particles, tin oxide particles, quartz sand particles, clay particles, mica particles, wollastonite particles, diatomaceous earth particles, chromic oxide particles, cerium oxide particles, red iron oxide particles, antimony trioxide particles, magnesium oxide particles, zirconium oxide particles, barium sulfate particles, barium carbonate particles, calcium carbonate particles, silicon carbide particles, and silicon nitride particles. These may be used in combination. Among them, preferable are silica particles and titania particles.

Examples of commercially available products of the silica particles include HDK H 2000, HDK H 2000/4, HDK H 2050EP, HVK21, and HDK H 1303 (all manufactured by Hoechst GmbH); R972, R974, RX200, RY200, R202, R805, and R812 (all manufactured by Nippon Aerosil Co., Ltd.).

Examples of commercially available products of the titania particles include P-25 (manufactured by Nippon Aerosil Co., Ltd.); STT-30, and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION).

The flowability improving agent is preferably hydrophobized.

A treating agent to be used for hydrophobization is not particularly limited. Examples thereof include a silane coupling agent, a silylation agent, a silane-coupling agent containing a fluoroalkyl group, an organic titanate-based coupling agent, an aluminum-based coupling agent, silicone oil, and modified-silicone oil.

Examples of the silane coupling agent includes methyl trimethoxy silane, methyl triethoxy silane, and octyl trimethoxy silane.

Examples of the silicone oil include dimethyl silicone oil, methylphenyl silicone oil, chlorophenyl silicone oil, methylhydrogen silicone oil.

Examples of the modified silicone oil include alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, (meth)acryl-modified silicone oil, and α-methylstyrene-modified silicone oil.

Examples of commercially available products of the hydrophobized titanium oxide particles include T-805 (manufactured by Nippon Aerosil Co., Ltd.); STT-30A, and STT-65S-S (both manufactured by Titan Kogyo, Ltd.); TAF-500T, and TAF-1500T (both manufactured by Fuji Titanium Industry Co., Ltd.); MT-100S, and MT-100T (both manufactured by TAYCA CORPORATION); and IT-S (manufactured by ISHIHARA SANGYO KAISHA, LTD.).

The flowability improving agent preferably contains hydrophobized inorganic particles having an average primary particle diameter of 1 nm to 100 nm, further preferably hydrophobized inorganic particles having the average primary particle diameter of 5 nm to 70 nm. The flowability improving agent particularly preferably contains hydrophobized inorganic particles having the average primary particle diameter of 20 nm or less and hydrophobized inorganic particles having the average primary particle diameter of 30 nm or more.

The flowability improving agent has typically the average primary particle diameter of 3 nm to 70 nm. When the average primary particle diameter of the flowability improving agent is less than 3 nm, the flowability improving agent may be embedded in the toner. When the average primary particle diameter is greater than 70 nm, a surface of a photoconductor may be damaged ununiformly.

The flowability improving agent has typically a specific surface area by BET method of 20 $m^2/g$ to 500 $m^2/g$.

An amount of the flowability improving agent contained in the toner is typically 0.1% by mass to 5% by mass, preferably 0.3% by mass to 3% by mass.

—Cleanability Improving Agent—

The cleanability improving agent is not particularly limited. Examples thereof include a fatty acid metal salt (e.g., zinc stearate, calcium stearate, and aluminum stearate); and resin particles such as polystyrene particles formed of soap-free emulsification polymerization, suspension polymerization, or dispersion polymerization; (meth)acrylate ester copolymer particles; polycondensated resin particles (e.g., silicone resin particles, benzoguanamine resin particles, and nylon resin particles); and thermosetting resin particles.

The resin particles have typically a volume average particle diameter of 0.01 μm to 1 μm.

The toner has preferably an average circularity of 0.93 to 0.99, which can further improve flowability under a high temperature and high humidity environment.

Note that, the circularity is defined as a ratio of a circumferential length of a circle having the same area as projected particle area to a circumferential length of projected particle image.

The toner preferably has a weight average particle diameter of 2 μm to 7 μm, and a ratio of the weight average particle diameter to a number average particle diameter of 1.00 to 1.25, which can further improve the flowability under a high temperature and high humidity environment.

The toner has typically a glass transition point of 40° C. to 70° C., preferably 45° C. to 55° C. When the glass transition point of the toner is less than 40° C., the toner may be deteriorated in heat resistant storability. When the glass transition point is more than 70° C., the toner may be deteriorated in low temperature fixability.

The toner has typically 100° C. or more, preferably 110° C. to 200° C. of a temperature TG' at which a storage modulus at a measuring frequency of 20 Hz is 10,000 dyne/$cm^2$. When the TG' is less than 100° C., the toner may be deteriorated in hot-offset resistance.

The toner has typically 180° C. or less, preferably 90° C. to 160° C. of a temperature Tη at which a viscosity at a measuring frequency of 20 Hz is 1,000 P. When the Tη is more than 180° C., the toner may be deteriorated in low temperature fixability.

A value of TG'-Tη is typically 0° C. or more, preferably 10° C. or more, further preferably 20° C. or more, which can improve low temperature fixability and hot-offset resistance of the toner.

The value of TG'-Tη is typically 100° C. or less, preferably 90° C. or less, further preferably 80° C. or less, which can improve heat resistant storability and low temperature fixability of the toner.

A method for producing the toner preferably include a step of preparing a toner composition liquid by dissolving or dispersing into an organic solvent a toner composition containing the isocyanate group-containing polyester prepolymer, the amines, the polyester, the colorant, and the releasing agent; a step of dispersing the toner composition liquid into an aqueous medium in which the vinyl-based resin is dispersed; and a step of removing the organic solvent from the aqueous medium in which the toner composition liquid is dispersed.

The organic solvent is not particularly limited. Examples thereof include ethyl acetate, methyl acetate, tetrahydrofuran, toluene, acetone, methanol, ethanol, propanol, butanol, isopropyl alcohol, hexane, tetrachloroethylene, chloroform, diethyl ether, methylene chloride, dimethyl sulfoxide, acetonitrile, acetic acid, formic acid, N,N-dimethyl formamide, benzene, and methyl ethyl ketone. These may be used in combination. Among them, preferable is ethyl acetate.

The vinyl-based resin dispersed in the aqueous medium acts as a particle size regulator. It is arranged around the toner particles, and eventually, covers surfaces of the toner base particles to thereby act as a shell.

The aqueous medium may be water alone, or may be a combination of water and a solvent miscible with water.

The solvent miscible with water is not particularly limited. Examples thereof include alcohols (e.g., methanol, isopropanol, ethylene glycol), dimethylformamide, tetrahydrofuran, cellosolve (e.g., methyl cellosolve), and lower ketones (e.g., acetone, and methyl ethyl ketone).

Note that, the isocyanate group-containing polyester prepolymer may be mixed with other toner composition upon dispersion in the aqueous medium.

The colorant, the releasing agent, and the charge controlling agent may not necessarily be added during dispersion in the aqueous medium, and may be added after the toner base particles are formed. For example, the colorant can be added by a conventional dyeing method after the toner base particles without the colorant are formed.

A method for dispersing the toner composition liquid into the aqueous medium is not particularly limited. Example thereof includes a method for dispersing with an application of shear force.

A disperser to be used for dispersing the toner composition liquid into the aqueous medium is not particularly limited. Examples thereof include a low-speed shearing disperser, a high-speed shearing disperser, a friction disperser, a high-pressure jetting disperser and an ultrasonic wave disperser. Among them, the high-speed shearing disperser is preferable for making the toner composition liquid dispersed in the aqueous medium to have a particle diameter of 2 μm to 20 μm.

In the case of using the high-speed shearing disperser, the number of rotation thereof is typically 1,000 rpm to 30,000 rpm, preferably 5,000 rpm to 20,000 rpm. In the case of a batch manner, a dispersion time is typically 0.1 min to 5 min. A temperature during dispersion is typically 0° C. to 150° C. (under a pressure), preferably 40° C. to 98° C. (under a pressure).

A mass ratio of the aqueous medium to the toner composition is typically 0.5 to 20, preferably 1 to 10. When the mass ratio of the aqueous medium to the toner composition is less than 0.5, a dispersion state of the toner composition may be deteriorated. The mass ratio of more than 20 is not economical.

The aqueous medium preferably contains a dispersing agent, which allows a particle size distribution of a dispersion to be sharp, and allows for stable dispersion.

The dispersing agent is not particularly limited. Examples thereof include anionic surfactants such as alkylbenzenesulfonic acid salts, α-olefin sulfonic acid salts and phosphoric acid esters; cationic surfactants such as amine salts (e.g., alkyl amine salts, amino alcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyl bis(aminoethyl)glycine, bis(octylaminoethyl)glycine and N-alkyl-N,N-dimethylammonium betaine.

The dispersing agent is preferably a fluoroalkyl group-containing surfactant, which allows an amount of the dispersing agent to be smaller.

Examples of a fluoroalkyl group-containing anionic surfactant include fluoroalkyl carboxylic acid having 2 to 10 carbon atoms and metal salts thereof, disodium perfluorooctane sulfonyl glutamate, sodium 3-[ω-fluoroalkyl(C6-C11) oxy]-1-alkyl(C3-C4) sulfonate, sodium 3-[ω-fluoroalkanoyl (C6-C8)-N-ethylamino]-1-propanesulfonate, fluoroalkyl (C11-C20) carboxylic acid and metal salts thereof, perfluoroalkylcarboxylic acid (C7-C13) and metal salts thereof, perfluoroalkyl(C4-C12)sulfonic acid and metal salts thereof, perfluorooctane sulfonic acid diethanol amide, N-propyl-N-(2-hydroxyethyl)perfluorooctane sulfone amide, perfluoroalkyl(C6-C10)sulfonamide propyl trimethylammonium salts, perfluoroalkyl(C6-C10)-N-ethylsulfonyl glycine salts and monoperfluoroaklyl(C6-C16) ethyl phosphate.

Examples of commercially available products of the fluoroalkyl group-containing anionic surfactant include SURFLON S-111, S-112, and S-113 (all manufactured by Asahi Glass Co., Ltd.); FLUORAD FC-93, FC-95, FC-98, and FC-129 (all manufactured by Sumitomo 3M Limited); UNIDYNE DS-101, and DS-102 (all manufactured by DAIKIN INDUSTRIES, LTD.); MEGAFAC F-110, F-120, F-113, F-191, F-812, and F-833 (all manufactured by DIC Corporation); EFTOP EF-102, 103, 104, 105, 112, 123A, 123B, 306A, 501, 201, and 204, (all manufactured by Mitsubishi Materials Electronic Chemicals Co., Ltd.); and FUTARGENT F-100, and F150 (both manufactured by NEOS COMPANY LIMITED).

Examples of a fluoroalkyl group-containing cationic surfactant include fluoroalkyl group-containing primary, secondary or tertiary aliphatic amine acids, aliphatic quaternary ammonium salts (e.g., perfluoroalkyl(C6-C10)sulfonamide propyltrimethyl ammonium salts), benzalkonium salts, benzethonium chloride, pyridinium salts and imidazolinium salts.

Examples of commercially available products of the fluoroalkyl group-containing cationic surfactant include SURFLON S-121 (manufactured by Asahi Glass Co., Ltd.); FLUORAD FC-135 (manufactured by Sumitomo 3M Limited); UNIDYNE DS-202 (manufactured by DAIKIN INDUSTRIES, LTD.); MEGAFAC F-150, and F-824 (all manufactured by DIC Corporation); EFTOP EF-132 (manufactured by Mitsubishi Materials Electronic Chemicals Co., Ltd); and FUTARGENT F-300 (manufactured by NEOS COMPANY LIMITED).

Moreover, a water-insoluble inorganic compound dispersing agent (e.g., tricalcium phosphate, calcium carbonate, titanium oxide, colloidal silica, and hydroxyapatite) can also used as the dispersing agent.

In the case where calcium phosphate which is soluble in an acid and an alkali is used as the dispersion agent, calcium phosphate is dissolved by the acid such as hydrochloric acid, followed by washing with water, to thereby remove calcium phosphate from the toner base particles. Alternatively, it can be removed through decomposition with an enzyme.

In the case where the dispersing agent is used, the dispersing agent may remain on surfaces of the toner base particles, but the dispersing agent is preferably removed by washing the toner base particles from the viewpoint of chargeability of the toner. In this case, the dispersing agent is preferably removed during classification described below.

A method for removing the organic solvent from the aqueous medium in which the toner composition liquid is dispersed is not particularly limited. Examples thereof include a method in which the aqueous medium in which the toner composition liquid is dispersed is gradually heated to thereby evaporate the organic solvent in droplets; and a method in which the aqueous medium in which the toner composition liquid is dispersed is sprayed in a dry atmosphere to thereby evaporate the organic solvent and the aqueous medium in droplets.

In the case of using the method in which the aqueous medium in which the toner composition liquid is dispersed is gradually heated to thereby evaporate the organic solvent in droplets, a rotary evaporator may be used.

The dry atmosphere is not particularly limited. Examples thereof include air, nitrogen, carbon dioxide and combustion gas.

The dry atmosphere is preferably heated to a temperature equivalent to or higher than the boiling point of the solvent.

In the case of using the method in which the aqueous medium in which the toner composition liquid is dispersed is sprayed in a dry atmosphere, preferably used is a spray dryer, a belt dryer or a rotary kiln, which allows the organic solvent and the aqueous medium to evaporate in a short time.

After the organic solvent is removed from the aqueous medium in which the toner composition liquid is dispersed, the following steps are repeatedly performed to thereby obtain toner base particles: a step of rough separation through centrifugation, a step of washing by means of a washing tank, and a step of drying by means of a hot air drier.

Thereafter, the toner base particles are preferably aged.

The toner base particles are typically aged at a temperature of 30° C. to 55° C., preferably 40° C. to 50° C.

The toner base particles are typically aged for 5 hours to 36 hours, preferably 10 hours to 24 hours.

In the case where the toner base particles have a wide particle size distribution, fine particles can be removed through classification.

A method for classification is not particularly limited. For example, a cyclone, a decanter, or a centrifugal separator may be used.

The toner base particles may be mixed together with different particles, such as the colorant, the releasing agent, the charge controlling agent, the flowability improving agent, and the cleanability improving to thereby obtain mixed particles, followed by optionally applying mechanical impact thereto, to thereby allow the different particles to adhere onto surfaces of the toner base particles.

A device for mixing the toner base particles with the different particles is not particularly limited. Example thereof includes HENSCHEL MIXER.

A method for applying mechanical impact to the mixed particles is not particularly limited. Examples thereof include a method in which impact is applied to the mixed particles by means of a blade rotating at a high speed; and a method in which the mixed particles are added into a high-speed air flow, followed by accelerating to thereby allow the mixed particles to crash into each other, or allow composite particles to crash into an impact plate.

A device for applying mechanical impact to the mixed particles is not particularly limited. Examples thereof include ANGMILL (manufactured by Hosokawa Micron Corporation), a modified I-TYPE MILL (manufactured by Nippon Pneumatic Mfg. Co., Ltd.) in which a pulverizing air pressure is reduced, HYBRIDIZATION SYSTEM (manufactured by Nara Machinery Co., Ltd.), KRYPTRON SYSTEM (manufactured by Kawasaki Heavy Industries, Ltd.) and an automatic mortar.

The toner base particles on which surfaces the different particles are adhered may be filtered through a ultrasonic wave sieve to remove coarse particles.

(Developer)

A developer of the present invention contains the toner and the carrier.

The toner can be mixed with the carrier to obtain a two-component developer.

A mass ratio of the toner to the carrier is typically 0.01 to 0.1.

The carrier is not particularly limited. Examples thereof include iron powder, ferrite powder, and magnetite powder.

The carrier has typically an average particle diameter of 20 μm to 200 μm.

The carrier may be coated with a resin.

The resin is not particularly limited. Examples thereof include an amino-based resin (e.g., a urea-formaldehyde resin, a melamine resin, a benzoguanamine resin, a urea resin, and a polyamide), a polyvinyl-based resin and a polyvinylidene-based resin (e.g., an acrylic resin, polymethyl methacrylate, polyacrylonitrile, polyvinyl acetate, polyvinyl alcohol, and polyvinyl butyral), a polystyrene-based resin (e.g., polystyrene and a styrene-acrylic copolymer), a halogenated olefin resin (e.g., polyvinyl chloride), a polyester-based resin (e.g., polyethylene terephthalate and polybutylene terephthalate), a polycarbonate-based resin, polyethylene, polyvinyl fluoride, polyvinylidene fluoride, polytrifluoroethylene, polyhexafluoropropylene, a copolymer of vinylidene fluoride and acrylic monomer, a copolymer of vinylidene fluoride and vinyl fluoride, a fluoroterpolymer (e.g., a terpolymer of tetrafluoroethylene, vinylidene fluoride, and a non-fluorinated monomer), and a silicone resin.

The resin coating may contain electroconductive powder, if necessary.

The electroconductive powder is not particularly limited. Examples thereof include metal powder, carbon black, titanium oxide powder, tin oxide powder and zinc oxide powder.

The electroconductive powder has typically an average particle diameter of 1 μm or less. When the average particle diameter is larger than 1 μm, it may be difficult to control electric resistance.

The toner can be used as a one-component magnetic developer or a one-component non-magnetic developer.

(Image Forming Apparatus)

An image forming apparatus includes a photoconductor, a charging unit, a exposing unit, a developing unit, a transfer unit, and a fixing unit; and, if necessary, further includes other units.

The charging unit is a unit configured to charge the photoconductor.

The exposing unit is a unit configured to expose the photoconductor charged to light, to thereby form an electrostatic latent image.

The developing unit is a unit containing the toner, and configured to develop with the toner the electrostatic latent image which has been formed on the photoconductor to thereby form a toner image.

The transfer unit is a unit configured to transfer the toner image which has been formed on the photoconductor onto a recording medium.

The fixing unit is a unit configured to fix the toner image which has been transferred onto the recording medium.

FIG. 1 illustrates a tandem electrophotographic apparatus as one example of an image forming apparatus.

In this figure, reference sign 100 denotes a main body of a copier, 200 denotes a paper feeding table on which the main body of the copier 100 is provided, 300 denotes a scanner provided on the main body of the copier 100, and 400 denotes an automatic document feeder (ADF) provided on the scanner 300. In the central part of the main body of the copier 100, an intermediate transfer member 10 in the form of an endless belt is provided. The intermediate transfer member 10 can be rotatably conveyed in the clockwise direction in this figure by the action of three support rollers 14, 15, and 16 around which the intermediate transfer member is stretched.

A cleaning device 17, which is configured to remove the residual toner remaining on the intermediate transfer member 10 after transferring a composite toner image, is provided on the left side of the support roller 15.

On the intermediate transfer member 10 stretched between the support roller 14 and the support roller 15, four image forming units 18 of yellow, cyan, magenta, and black are horizontally aligned along the conveying direction of the intermediate transfer member, to thereby constitute the image forming unit 20.

An exposing device 21 is provided on the image forming unit 20. A secondary transfer device 22 is provided at the opposite side of the intermediate transfer member 10 to the side on which the image forming unit 20 is provided. The secondary transfer device 22 is formed by stretching a secondary transfer belt 24, which is an endless belt, between two rollers 23, and is provided so as to be pressed against the third support roller 16 via the intermediate transfer member 10. Thus, the composite toner image on the intermediate transfer member 10 is transferred onto a sheet (not illustrated).

A fixing device 25 configured to fix the composite toner image which has been transferred onto the sheet is provided laterally to the secondary transfer device 22. The fixing device 25 contains a fixing belt 26, which is an endless belt, and a pressure roller 27 provided to be pressed against the fixing belt 26.

The secondary transfer device 22 also has a sheet conveying function for conveying the sheet, on which the composite toner image has been transferred, to the fixing device 25.

Note that, a transfer roller or a non-contact charger may be provided as the secondary transfer device 22.

A sheet reverser 28, which is configured to reverse the sheet to perform image formation on both sides of the sheet, is provided below the secondary transfer device 22 and the fixing device 25, and horizontal to the image forming unit 20.

When taking a copy by means of the tandem electrophotographic device, a document is set on a document table 30 of the automatic document feeder 400. Alternatively, the automatic document feeder 400 is opened, a document is set on a contact glass 32 of the scanner 300, and then the automatic document feeder 400 is closed to press the document.

In the case where the document is set on the automatic document feeder 400, once a start switch (not illustrated) is pressed, the document is transported onto the contact glass 32, and then the scanner 300 is driven to allow a first traveling body 33 and a second traveling body 34 to travel. Meanwhile, in the case where the document is set on the contact glass 32, the scanner is immediately driven in the same manner as mentioned. Then, light is emitted from a light source (not illustrated) of the first traveling body 33, and reflected light from the surface of the document is reflected. Thereafter, the reflected light is further reflected by a mirror of the second traveling body 34, passed through an image formation lens 35, and received by a read sensor 36 to thereby read contents of the document.

Once the start switch (not illustrated) is pressed, one of the support rollers 14, 15, and 16 is rotatably driven by a driving motor (not illustrated) to thereby driven-rotate the other two support rollers and rotatably convey the intermediate transfer member 10. At the same time, in each image forming unit 18, photoconductors 40K, 40Y, 40M, and 40C are rotated, to thereby form toner images of black, yellow, magenta, or cyan on the photoconductors 40K, 40Y, 40M, and 40C. Then, along the movement of the intermediate transfer member 10, these monochrome images are sequentially transferred onto the intermediate transfer member, to thereby form a composite toner image on the intermediate transfer member 10.

Once the start switch (not illustrated) is pressed, one of the paper feeding rollers 42 of the paper feeding table 200 is rotated to eject sheets from one of multiple paper feeding cassettes 44 of a paper bank 43. The ejected sheets are separated one by one by a separation roller 45 to send to a paper feeding path 46, and then conveyed by a conveyance roller 47 into a paper feeding path 48 within the main body of the copier 100. The sheet conveyed in the paper feeding path is then abutted against a registration roller 49 to stop. Alternatively, sheets on a manual-paper feeding tray 51 are ejected by rotating a paper feeding roller 50, separated one by one by a separation roller 52 to send to a manual paper feeding path 53, and then abutted against the registration roller 49 to stop.

Next, the registration roller 49 is rotated synchronously with the movement of the composite toner image on the intermediate transfer member 10, and a sheet is sent to between the intermediate transfer member 10 and the secondary transfer device 22. Then, the composite toner image is transferred onto the sheet by the secondary transfer device 22.

The sheet on which the composite toner image has been transferred is conveyed by the secondary transfer device 22 to the fixing device 25. Then, the composite toner image is fixed in the fixing device 25 with an application of heat and pressure.

The sheet on which the composite toner image is fixed is changed its traveling direction by a switch craw 55, ejected by an ejecting roller 56, and then stacked on a paper output tray 57. Alternatively, the sheet on which the composite toner image is fixed is changed its traveling direction by the switch craw 55, and conveyed to the sheet reverser 28, where the sheet is reversed. Thereafter, the composite toner image is also fixed on the back side of the sheet. Then, the sheet is ejected by the ejecting roller 56, and stacked on the paper output tray 57.

Meanwhile, the residual toner remaining on the intermediate transfer member 10 onto which the composite toner image has been transferred is removed by the cleaning device 17 to be prepared for a forthcoming image formation carried out by the image forming unit 20.

The registration roller 49 is generally grounded, but bias may be applied thereto for removing paper powder of the sheet.

Figure 2:
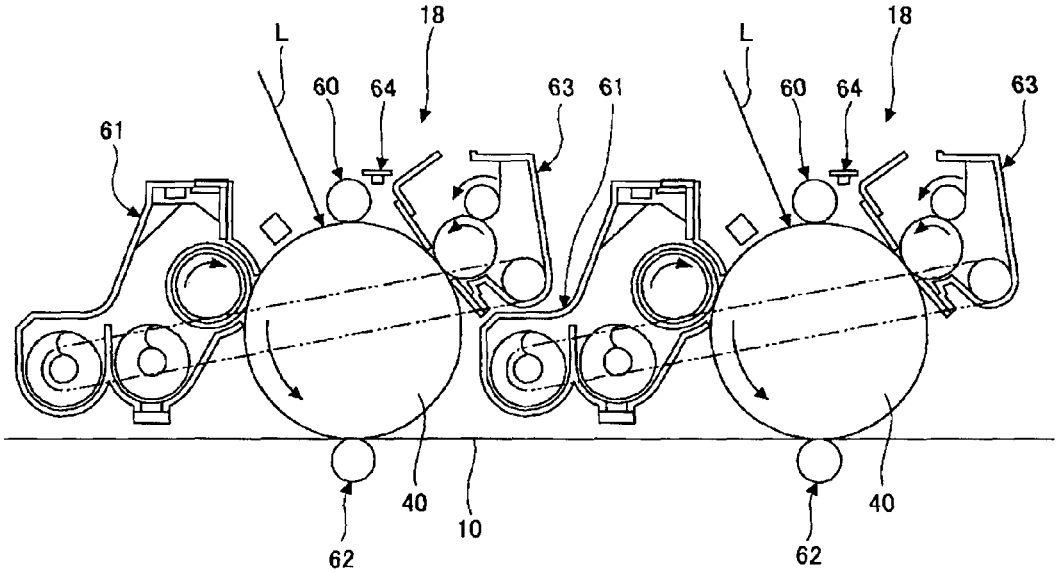
FIG. 2 is a partially enlarged diagram of the image forming apparatus illustrated in FIG. 1.

Note that, in the image forming unit 20, each image forming unit 18 includes, as illustrated in FIG. 2, a charging device 60, a developing device 61, a primary transfer device 62, a cleaning device 63, and a charge eliminating device 64 around the drum-shaped photoconductor 40. In FIG. 2, a sign L denotes laser light.

The tandem electrophotographic apparatus has a system velocity of 0.2 m/s to 3.0 m/s. The fixing device 25 has preferably a contact pressure of a fixing medium of 10 $N/cm^2$ to 3,000 $N/cm^2$, and a fixing nip time of 30 ms to 400 ms, which makes it possible to ensure flowability of the toner, and to perform developing, transfer, and fixing with only little contamination on a developing member. Additionally, the toner is allowed to be deformed to thereby control melt-fixing onto a recording medium (e.g., paper), and to thereby prevent hot-offset from occurring. Moreover, a quantity of heat required for fixing the toner can be controlled. As a result, image quality can be ensured with a small amount of electrical power consumption.

Note that, the system velocity is determined as follows. One hundred sheets of A4-size paper are continuously fed in a longitudinal feeding direction (length of sheet in the feeding direction: 297 mm), and the system velocity is calculated according to the following expression: 100× 297/A (where A denotes the feeding time [s] from start to finish).

Note that, the fixing nip time can be calculated from the linear velocity and the fixing nip width of the fixing medium.

(Process Cartridge)

A process cartridge includes the photoconductor and the developing unit configured to develop with the toner the electrostatic latent image formed on the photoconductor, which are integrally supported, and is detachably mounted on a main body of the image forming apparatus.

Figure 3:
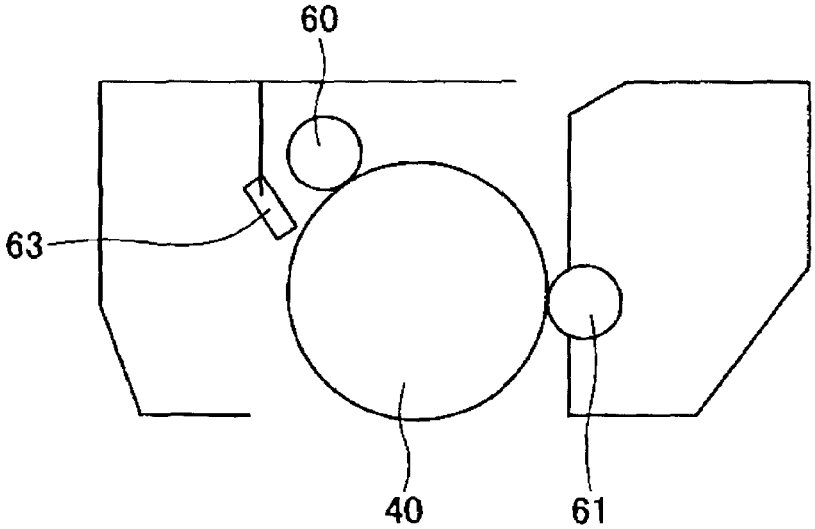
FIG. 3 is a schematic diagram illustrating one example of a process cartridge.

FIG. 3 illustrates one example of a process cartridge.

The process cartridge includes the photoconductor 40, the charging device 60, the developing device 61, and the cleaning device 63, which are integrally supported, and is detachably mounted on the main body of the image forming apparatus.

The image forming apparatus is not particularly limited. Examples thereof include a copier and a printer.

EXAMPLES

The present invention now will be described with reference to Examples, but is not limited thereto. Note that, "part(s)" means "part(s) by mass."

Example 1

Synthesis of Vinyl-Based Resin Dispersion Liquid 1

A reaction vessel equipped with a stirring bar and a thermometer was charged with 683 parts by mass of water, 11 parts by mass of sodium salt of sulfuric acid ester of methacrylic acid-ethylene oxide adduct (ELEMINOL RS-30, manufactured by Sanyo Chemical Industries, Ltd.), 20 parts by mass of polylactic acid (number average molecular weight: 12,000, weight average molecular weight: 38,000, and Tg: 52° C.), 50 parts by mass of styrene, 100 parts by mass of methacrylic acid, 80 parts by mass of butyl acrylate, and 1 part by mass of ammonium persulfate, followed by stirring for 30 min at 3,800 rpm. The resultant was heated to 75° C. and then allowed to react for 4 hours. Subsequently, 30 parts by mass of a 1% by mass aqueous ammonium persulfate solution was added thereto, followed by aging for 6 hours at 75° C., to thereby obtain [vinyl-based resin dispersion liquid 1]. The [vinyl-based resin dispersion liquid 1] was found to have a volume average particle diameter of 230 nm as measured by a laser diffraction/scattering type particle size distribution measurement device (LA-920, manufactured by HORIBA, Ltd.). The [vinyl-based resin dispersion liquid 1] was partially dried, followed by isolating a resin content. The resin content was found to have a glass transition point of 58° C. and a weight average molecular weight of 40,000.

<Preparation of Aqueous Phase 1>

Water (990 parts by mass), the [vinyl-based resin dispersion liquid 1] (83 parts by mass), a 48.3% by mass sodium dodecyldiphenyl ether disulfonate aqueous solution (ELEMINOL MON-7, manufactured by Sanyo Chemical Industries, Ltd.) (37 parts by mass), and ethyl acetate (90 parts by mass) were mixed together and stirred, to thereby obtain [aqueous phase 1].

<Synthesis of Non-Crystalline Polyester 1>

A reaction vessel equipped with a cooling tube, a stirrer, and a nitrogen-inlet tube was charged with 450 parts by mass of bisphenol A propylene oxide (2 mol) adduct, 280 parts by mass of bisphenol A propylene oxide (3 mol) adduct, 247 parts by mass of terephthalic acid, 75 parts by mass of isophthalic acid, 10 parts by mass of maleic anhydride, and 2 parts by mass of titanium dihydroxy bis(triethanol aminate) serving as a condensation catalyst, followed by allowing to react together 8 hours at 220° C. with generated water being distilled off under a nitrogen stream. The resultant was allowed to further react under a reduced pressure of 5 mmHg to 20 mmHg, and removed from the reaction vessel at a time when an acid value thereof reached 8 mgKOH/g. Thereafter, the resultant was cooled to room temperature, and then, pulverized to thereby obtain [non-crystalline polyester 1]. The [non-crystalline polyester 1] was found to have a number average molecular weight of 5,300, the weight average molecular weight of 25,600, the glass transition point of 59° C., and the acid value of 9 mgKOH/g.

<Synthesis of Polyester Prepolymer 1>

A reaction vessel equipped with a cooling tube, a stirrer, and a nitrogen-inlet tube was charged with 680 parts by mass of bisphenol A ethylene oxide (2 mol) adduct, 83 parts by mass of bisphenol A propylene oxide (2 mol) adduct, 283 parts by mass of terephthalic acid, 22 parts by mass of trimellitic anhydride, and 2 parts by mass of dibutyl tin oxide serving as a catalyst, followed by allowing to react for 7 hours at 230° C. Then, the resultant was allowed to further react for 5 hours under the reduced pressure of 10 mmHg to 15 mmHg, to thereby obtain [hydroxyl group-containing polyester 1]. The [hydroxyl group-containing polyester 1] was found to have the number average molecular weight of 2,400, the weight average molecular weight of 11,000, the glass transition point of 55° C., the acid value of 0.5 mgKOH/g, and an hydroxyl value of 52 mgKOH/g.

Next, a reaction vessel equipped with a cooling tube, a stirrer, and a nitrogen-inlet tube was charged with 410 parts by mass of the [hydroxyl group-containing polyester 1], 89 parts by mass of isophorone diisocyanate, and 500 parts by mass of ethyl acetate, followed by allowing to react for 5 hours at 100° C., to thereby obtain [polyester prepolymer 1]. The [polyester prepolymer 1] was found to have a free isocyanate content of 1.53% by mass.

<Synthesis of Ketimine 1>

A reaction vessel equipped with a stirring bar and a thermometer was charged with 170 parts by mass of isophorone diamine, and 75 parts by mass of methyl ethyl ketone, followed by allowing to react for 4.5 hours at 50° C., to thereby obtain [ketimine 1]. The [ketimine 1] was found to have an amine value of 417 mgKOH/g.

<Preparation of Masterbatch>

The [non-crystalline polyester 1] (100 parts by mass), a cyan pigment C.I. Pigment blue 15:3 (100 parts by mass), and ion-exchanged water (100 parts by mass) were mixed together with HENSCHEL MIXER (manufactured by NIPPON COKE & ENGINEERING CO., LTD.), followed by kneading with an open roll type kneader (KNEADEX, manufactured by NIPPON COKE & ENGINEERING CO., LTD.) at 90° C. for 1 hour. Then, the resultant was roll-cooled and pulverized with a pulverized to thereby obtain [masterbatch 1].

<Synthesis of Crystalline Polyester 1>

A reaction vessel equipped with a cooling tube, a stirrer, and a nitrogen-inlet tube was charged with 1,200 parts by mass of 1,6-hexanediol, 1,200 parts by mass of decanedioic acid, 0.4 parts by mass of dibutyl tin oxide serving as a catalyst to thereby obtain a mixture. Air in the reaction vessel was replaced with a nitrogen gas, and then the mixture was stirred for 5 hours at 180 rpm. Thereafter, the resultant was gradually heated to 210° C. under the reduced pressure, followed by stirring for 1.5 hours to thereby obtain [crystalline polyester 1]. The [crystalline polyester 1] was found to have the number average molecular weight of 3,400, the weight average molecular weight of 15,000, and the melting point of 64° C.

<Preparation of Raw Material Mixed Liquid 1>

A vessel equipped with a stirring bar and a thermometer was charged with 530 parts by mass of the [non-crystalline polyester 1], 110 parts by mass of paraffin wax (melting point: 90° C.), 60 parts by mass of the [crystalline polyester 1], and 947 parts by mass of ethyl acetate, followed by heating to 80° C. with stirring. The resultant was kept at 80° C. for 5 hours, followed by cooling to 30° C. for 1 hour. To this, were added 100 parts by mass of the [masterbatch 1] and 100 parts by mass of ethyl acetate, followed by mixing for 1 hour to thereby obtain [raw material mixed liquid 1].

<Preparation, Emulsification, and Desolvation of Oil Phase 1>

The [raw material mixed liquid 1] (1,324 parts by mass) was transferred to another vessel, followed by dispersing with 3 passes by means of a bead mill (ULTRA VISCOMILL, manufactured by AIMEX CO., Ltd.) under the following conditions: a liquid feed rate of 1 kg/hr, a disk circumferential velocity of 6 m/s, and 0.5 mm-zirconia beads packed to 80% by volume.

Next, 1,324 parts by mass of a 65% by mass [non-crystalline polyester 1] solution in ethyl acetate was added thereto, followed by dispersing with 2 passes by means of the bead mill (ULTRA VISCOMILL, manufactured by AIMEX CO., Ltd.) under the above-described conditions to thereby obtain [dispersion liquid 1]. The [dispersion liquid 1] was found to have a solid content (130° C., 30 min) of 50% by mass.

A vessel was charged with 749 parts by mass of the [dispersion liquid 1], 120 parts by mass of the [polyester prepolymer 1], and 3.5 parts by mass of the [ketimine 1], followed by mixing by means of TK HOMOMIXER (manufactured by PRIMIX Corporation) at 5,000 rpm for 5 min to thereby obtain [oil phase 1]. To the vessel, 1,200 parts by mass of the [aqueous phase 1] was added, followed by mixing by means of TK HOMOMIXER at 10,000 rpm for 1.5 hours, to thereby obtain [emulsified slurry 1].

A vessel equipped with a stirrer and a thermometer was charged with the [emulsified slurry 1], followed by desolvating at 30° C. for 8 hours, and aging at 40° C. for 24 hours, to thereby obtain [dispersion slurry 1].

<Washing/Drying>

After filtering 100 parts by mass of the [dispersion slurry 1] under the reduced pressure, the following series of operations was repeated twice. To the resultant filtration cake, 100 parts by mass of ion-exchanged water was added, followed by mixing by means of the TK HOMOMIXER (manufactured by PRIMIX Corporation) at 12,000 rpm for 10 min, and filtering. To the resultant filtration cake, 100 parts by mass of a 10% by mass sodium hydroxide aqueous solution was added, followed by mixing by means of the TK HOMOMIXER (manufactured by PRIMIX Corporation) at 12,000 rpm for 30 min, and filtering under the reduced pressure. To the resultant filtration cake, 100 parts by mass of 10% by mass hydrochloric acid was added, followed by mixing by means of the TK HOMOMIXER (manufactured by PRIMIX Corporation) at 12,000 rpm for 10 min, and filtering. To the resultant filtration cake, 300 parts by mass of ion-exchanged water was added, followed by mixing by means of the TK HOMOMIXER (manufactured by PRIMIX Corporation) at 12,000 rpm for 10 min, and filtering.

The resultant filtration cake was dried with an air-circulating drier for 48 hours at 45° C., and then passed through a sieve with a mesh size of 75 μm, to thereby obtain [toner base particles]. Each of the resultant [toner base particles] was found to have a core-shell structure.

Thereafter, 100 parts by mass of the [toner base particles] was mixed with 1 part of hydrophobized silica having an average primary particle diameter of 13 nm by means of HENSCHEL MIXER, to thereby obtain a toner.

Example 2

Synthesis of Vinyl-Based Resin Dispersion Liquid 2

A reaction vessel equipped with a stirring bar and a thermometer was charged with 683 parts by mass of water, 11 parts by mass of sodium salt of sulfuric acid ester of methacrylic acid-ethylene oxide adduct (ELEMINOL RS-30, manufactured by Sanyo Chemical Industries, Ltd.), 20 parts by mass of polylactic acid (number average molecular weight: 12,000, weight average molecular weight: 38,000, and Tg: 52° C.), 70 parts by mass of styrene, 90 parts by mass of methacrylic acid, 60 parts by mass of butyl acrylate, and 1 part by mass of ammonium persulfate, followed by stirring for 30 min at 3,800 rpm. The resultant was heated to 75° C., and then allowed to react for 3 hours. Subsequently, 30 parts by mass of a 1% by mass aqueous ammonium persulfate solution was added thereto, followed by aging for 6 hours at 75° C., to thereby obtain [vinyl-based resin dispersion liquid 2]. The [vinyl-based resin dispersion liquid 2] was found to have the volume average particle diameter of 140 nm as measured by a laser diffraction/scattering type particle size distribution measurement device (LA-920, manufactured by HORIBA, Ltd.). The [vinyl-based resin dispersion liquid 2] was partially dried, followed by isolating a resin content. The resin content was found to have the glass transition point of 60° C. and the weight average molecular weight of 140,000.

<Preparation of Raw Material Mixed Liquid 2>

A vessel equipped with a stirring bar and a thermometer was charged with 490 parts by mass of the [non-crystalline polyester 1], 110 parts by mass of paraffin wax (melting point: 90° C.), 100 parts by mass of the [crystalline polyester 1], and 947 parts by mass of ethyl acetate, followed by heating to 80° C. with stirring. Then, the resultant was kept at 80° C. for 5 hours, followed by cooling to 30° C. for 1 hour. To this, were added 100 parts by mass of the [masterbatch 1] and 100 parts by mass of ethyl acetate, followed by mixing for 1 hour to thereby obtain [raw material mixed liquid 2].

A toner was obtained in the same manner as in Example 1, except that the [vinyl-based resin dispersion liquid 1] and the [raw material mixed liquid 1] were changed to the [vinyl-based resin dispersion liquid 2] and the [raw material mixed liquid 2]. Note that, each of the resultant toner base particles was found to have a core-shell structure.

Example 3

Synthesis of Vinyl-Based Resin Dispersion Liquid 3

A reaction vessel equipped with a stirring bar and a thermometer was charged with 683 parts by mass of water, 11 parts by mass of sodium salt of sulfuric acid ester of methacrylic acid-ethylene oxide adduct (ELEMINOL RS-30, manufactured by Sanyo Chemical Industries, Ltd.), 20 parts by mass of polylactic acid (number average molecular weight: 12,000, weight average molecular weight: 38,000, and Tg: 52° C.), 60 parts by mass of styrene, 100 parts by mass of methacrylic acid, 70 parts by mass of butyl acrylate, and 1 part by mass of ammonium persulfate, followed by stirring for 20 min at 2,000 rpm. The resultant was heated to 75° C., and then allowed to react for 3 hours. Subsequently, 30 parts by mass of a 1% by mass aqueous ammonium persulfate solution was added thereto, followed by aging for 12 hours at 65° C., to thereby obtain [vinyl-based resin dispersion liquid 3]. The [vinyl-based resin dispersion liquid 3] was found to have the volume average particle diameter of 630 nm as measured by a laser diffraction/scattering type particle size distribution measurement device (LA-920, manufactured by HORIBA, Ltd.). The [vinyl-based resin dispersion liquid 3] was partially dried, followed by isolating a resin content. The resin content was found to have the glass transition point of 59° C. and the weight average molecular weight of 110,000.

A toner was obtained in the same manner as in Example 2, except that the [vinyl-based resin dispersion liquid 2] was changed to the [vinyl-based resin dispersion liquid 3]. Note that, each of the resultant toner base particles was found to have a core-shell structure.

Example 4

Preparation of Raw Material Mixed Liquid 3

A vessel equipped with a stirring bar and a thermometer was charged with 178 parts by mass of the [non-crystalline polyester 1], 120 parts by mass of paraffin wax (melting point: 90° C.), 40 parts by mass of the [crystalline polyester 1], and 947 parts by mass of ethyl acetate, followed by heating to 80° C. with stirring. The resultant was kept at 80° C. for 5 hours, followed by cooling to 30° C. for 1 hour. To this, were added 100 parts by mass of the [masterbatch 1] and 100 parts by mass of ethyl acetate, followed by mixing for 1 hour to thereby obtain [raw material mixed liquid 3].

A toner was obtained in the same manner as in Example 2, except that the [raw material mixed liquid 2] was changed to the [raw material mixed liquid 3]. Note that, each of the resultant toner base particles was found to have a core-shell structure.

Example 5

A toner was obtained in the same manner as in Example 1, except that the [vinyl-based resin dispersion liquid 1] and the [raw material mixed liquid 1] were changed to the [vinyl-based resin dispersion liquid 3] and the [raw material mixed liquid 3]. Note that, each of the resultant toner base particles was found to have a core-shell structure.

Example 6

Synthesis of Vinyl-Based Resin Dispersion Liquid 4

A reaction vessel equipped with a stirring bar and a thermometer was charged with 683 parts by mass of water, 11 parts by mass of sodium salt of sulfuric acid ester of methacrylic acid-ethylene oxide adduct (ELEMINOL RS-30, manufactured by Sanyo Chemical Industries, Ltd.), 40 parts by mass of polylactic acid (number average molecular weight: 12,000, weight average molecular weight: 38,000, and Tg: 52° C.), 60 parts by mass of styrene, 80 parts by mass of methacrylic acid, 50 parts by mass of butyl acrylate, and 1 part by mass of ammonium persulfate, followed by stirring for 30 min at 3,800 rpm. The resultant was heated to 70° C., and then allowed to react for 3 hours. Subsequently, 30 parts by mass of a 1% by mass aqueous ammonium persulfate solution was added thereto, followed by aging for 3 hours at 70° C., to thereby obtain [vinyl-based resin dispersion liquid 4]. The [vinyl-based resin dispersion liquid 4] was found to have the volume average particle diameter of 64 nm as measured by a laser diffraction/scattering type particle size distribution measurement device (LA-920, manufactured by HORIBA, Ltd.). The [vinyl-based resin dispersion liquid 4] was partially dried, followed by isolating a resin content. The resin content was found to have the glass transition point of 62° C. and the weight average molecular weight of 130,000.

A toner was obtained in the same manner as in Example 1, except that the [vinyl-based resin dispersion liquid 1] was changed to the [vinyl-based resin dispersion liquid 4]. Note that, each of the resultant toner base particles was found to have a core-shell structure.

Comparative Example 1

Synthesis of Vinyl-Based Resin Dispersion Liquid 5

A reaction vessel equipped with a stirring bar and a thermometer was charged with 683 parts by mass of water, 11 parts by mass of sodium salt of sulfuric acid ester of methacrylic acid-ethylene oxide adduct (ELEMINOL RS-30, manufactured by Sanyo Chemical Industries, Ltd.), 20 parts by mass of polylactic acid (number average molecular weight: 12,000, weight average molecular weight: 38,000, and Tg: 52° C.), 30 parts by mass of styrene, 110 parts by mass of methacrylic acid, 80 parts by mass of butyl acrylate, and 1 part by mass of ammonium persulfate, followed by stirring for 30 min at 3,800 rpm. The resultant was heated to 75° C., and then allowed to react for 2 hours. Subsequently, 30 parts by mass of a 1% by mass aqueous ammonium persulfate solution was added thereto, followed by aging for 6 hours at 75° C., to thereby obtain [vinyl-based resin dispersion liquid 5]. The [vinyl-based resin dispersion liquid 5] was found to have the volume average particle diameter of 45 nm as measured by a laser diffraction/scattering type particle size distribution measurement device (LA-920, manufactured by HORIBA, Ltd.). The [vinyl-based resin dispersion liquid 5] was partially dried, followed by isolating a resin content. The resin content was found to have the glass transition point of 62° C. and the weight average molecular weight of 140,000.

<Preparation of Raw Material Mixed Liquid 4>

A vessel equipped with a stirring bar and a thermometer was charged with 440 parts by mass of [non-crystalline polyester 1], 110 parts by mass of paraffin wax (melting point: 90° C.), 150 parts by mass of [crystalline polyester 1], and 947 parts by mass of ethyl acetate, followed by heating to 80° C. with stirring. The resultant was kept at 80° C. for 5 hours, followed by cooling to 30° C. for 1 hour. To this, were added 100 parts by mass of the [masterbatch 1] and 100 parts by mass of ethyl acetate, followed by mixing for 1 hour to thereby obtain [raw material mixed liquid 4].

A toner was obtained in the same manner as in Example 1, except that the [vinyl-based resin dispersion liquid 1] and the [raw material mixed liquid 1] were changed to the [vinyl-based resin dispersion liquid 5] and the [raw material mixed liquid 4]. Note that, each of the resultant toner base particles was found to have a core-shell structure.

Comparative Example 2

Synthesis of Vinyl-Based Resin Dispersion Liquid 6

A reaction vessel equipped with a stirring bar and a thermometer was charged with 683 parts by mass of water, 11 parts by mass of sodium salt of sulfuric acid ester of methacrylic acid-ethylene oxide adduct (ELEMINOL RS-30, manufactured by Sanyo Chemical Industries, Ltd.), 20 parts by mass of polylactic acid (number average molecular weight: 12,000, weight average molecular weight: 38,000, and Tg: 52° C.), 90 parts by mass of styrene, 70 parts by mass of methacrylic acid, 70 parts by mass of butyl acrylate, and 1 part by mass of ammonium persulfate, followed by stirring for 20 min at 2,000 rpm. The resultant was heated to 75° C., and then allowed to react for 3 hours. Subsequently, 30 parts by mass of a 1% by mass aqueous ammonium persulfate solution was added thereto, followed by aging for 12 hours at 65° C., to thereby obtain [vinyl-based resin dispersion liquid 6]. The [vinyl-based resin dispersion liquid 6] was found to have the volume average particle diameter of 750 nm as measured by a laser diffraction/scattering type particle size distribution measurement device (LA-920, manufactured by HORIBA, Ltd.). The [vinyl-based resin dispersion liquid 6] was partially dried, followed by isolating a resin content. The resin content was found to have the glass transition point of 60° C. and the weight average molecular weight of 130,000.

A toner was obtained in the same manner as in Comparative Example 1, except that the [vinyl-based resin dispersion liquid 5] was changed to the [vinyl-based resin dispersion liquid 6]. Note that, each of the resultant toner base particles was found to have a core-shell structure.

Comparative Example 3

Preparation of Raw Material Mixed Liquid 5

A vessel equipped with a stirring bar and a thermometer was charged with 580 parts by mass of the [non-crystalline polyester 1], 110 parts by mass of paraffin wax (melting point: 90° C.), 10 parts by mass of the [crystalline polyester 1], and 947 parts by mass of ethyl acetate, followed by heating to 80° C. with stirring. The resultant was kept at 80° C. for 5 hours, followed by cooling to 30° C. for 1 hour. To this, were added 100 parts by mass of the [masterbatch 1] and 100 parts by mass of ethyl acetate, followed by mixing for 1 hour to thereby obtain [raw material mixed liquid 5].

A toner was obtained in the same manner as in Comparative Example 1, except that the [raw material mixed liquid 4] was changed to the [raw material mixed liquid 5]. Note that, each of the resultant toner base particles was found to have a core-shell structure.

Comparative Example 4

A toner was obtained in the same manner as in Example 1, except that the [vinyl-based resin dispersion liquid 1] and the [raw material mixed liquid 1] were changed to the [vinyl-based resin dispersion liquid 6] and the [raw material mixed liquid 5]. Note that, each of the resultant toner base particles was found to have a core-shell structure.

Comparative Example 5

A toner was obtained in the same manner as in Example 1, except that the [vinyl-based resin dispersion liquid 1] and the [raw material mixed liquid 1] were changed to the [vinyl-based resin dispersion liquid 6] and the [raw material mixed liquid 3]. Note that, each of the resultant toner base particles was found to have a core-shell structure.

Comparative Example 6

A toner was obtained in the same manner as in Example 1, except that the [vinyl-based resin dispersion liquid 1] and the [raw material mixed liquid 1] were changed to the [vinyl-based resin dispersion liquid 4] and the [raw material mixed liquid 2]. Note that, each of the resultant toner base particles was found to have a core-shell structure.

Comparative Example 7

A toner was obtained in the same manner as in Example 1, except that the [vinyl-based resin dispersion liquid 1] and the [raw material mixed liquid 1] were changed to the [vinyl-based resin dispersion liquid 2] and the [raw material mixed liquid 4]. Note that, each of the resultant toner base particles was found to have a core-shell structure.

Comparative Example 8

A toner was obtained in the same manner as in Example 1, except that the [raw material mixed liquid 1] was changed to the [raw material mixed liquid 5]. Note that, each of the resultant toner base particles was found to have a core-shell structure.

Comparative Example 9

A toner was obtained in the same manner as in Example 1, except that the [vinyl-based resin dispersion liquid 1] and the [raw material mixed liquid 1] were changed to the [vinyl-based resin dispersion liquid 3] and the [raw material mixed liquid 5]. Note that, each of the resultant toner base particles was found to have a core-shell structure.

Comparative Example 10

A toner was obtained in the same manner as in Example 1, except that the [vinyl-based resin dispersion liquid 1] and the [raw material mixed liquid 1] were changed to the [vinyl-based resin dispersion liquid 4] and the [raw material mixed liquid 4]. Note that, each of the resultant toner base particles was found to have a core-shell structure.

Analyzing methods were as follows.

(Weight Average Molecular Weight)

The weight average molecular weight was measured using a high-speed GPC device (HLC-8120GPC, manufactured by Tosoh Corporation), a column (TSK GEL SUPER HM-M (15 cm), manufactured by Tosoh Corporation), and THF serving as eluent. Note that, the weight average molecular weight was calculated from a molecular weight calibration curve prepared with a monodispersed polystyrene standard sample.

(Core-Shell Structure)

First, about one spatula-full of the toner was embedded in an epoxy resin and then the resin was cured. The toner was stained by exposing to a gas of ruthenium tetraoxide, or osmium tetraoxide, or other dying agents for 1 min to 24 hours, to thereby identify a core and a shell thereof. Then, the epoxy resin was cut by a knife to expose a cross-section of the toner. Thereafter, an ultramicrotome (ULTRACUT UCT, manufactured by Leica Microsystems, with the use of a diamond knife) was used to prepare an ultra-thin section (thickness: 200 nm) of the toner. Then, the ultra-thin section was observed under a transmission electron microscope (H7000, manufactured by Hitachi High-Technologies Corporation) at the accelerating voltage of 100 kV. Thus, to thereby confirm a core-shell structure.

Table 1 shows properties of toners of Examples 1 to 6 and Comparative Examples 1 to 4.

TABLE 1

| | Spreadability under non-pressurized condition | Log G' [log Pa] | tan δ | Degree of crystallinity [%] | Content of ethyl acetate [μg/g] | Average circularity | $D_4$ [μm] | $D_4$/Dn |
|---|---|---|---|---|---|---|---|---|
| Ex. 1 | 1.30 | 4.8 | 1.3 | 21 | 9 | 0.96 | 4.5 | 1.10 |
| Ex. 2 | 2.50 | 4.0 | 2.2 | 25 | 18 | 0.97 | 4.2 | 1.09 |
| Ex. 3 | 1.20 | 4.1 | 2.1 | 24 | 4 | 0.98 | 3.7 | 1.16 |
| Ex. 4 | 2.30 | 5.0 | 1.1 | 11 | 23 | 0.97 | 4.1 | 1.08 |
| Ex. 5 | 1.25 | 4.9 | 1.2 | 12 | 2 | 0.94 | 5.1 | 1.11 |
| Ex. 6 | 2.40 | 4.7 | 1.5 | 20 | 1 | 0.96 | 4.7 | 1.12 |
| Com. Ex. 1 | 2.60 | 3.9 | 2.3 | 30 | 31 | 0.97 | 4.6 | 1.18 |
| Com. Ex. 2 | 1.10 | 3.8 | 2.4 | 31 | 30 | 0.93 | 6.6 | 1.18 |
| Com. Ex. 3 | 2.70 | 5.1 | 1.0 | 8 | 49 | 0.93 | 3.9 | 1.30 |
| Com. Ex. 4 | 1.10 | 5.2 | 0.9 | 7 | 27 | 0.94 | 5.4 | 1.15 |
| Com. Ex. 5 | 1.15 | 5.0 | 1.1 | 9 | 26 | 0.94 | 5.3 | 1.15 |
| Com. Ex. 6 | 2.70 | 4.0 | 2.1 | 29 | 34 | 0.96 | 4.7 | 1.21 |
| Com. Ex. 7 | 2.40 | 3.7 | 2.0 | 10 | 28 | 0.95 | 4.3 | 1.19 |
| Com. Ex. 8 | 1.30 | 5.3 | 1.1 | 8 | 13 | 0.96 | 4.4 | 1.29 |
| Com. Ex. 9 | 1.25 | 5.0 | 0.8 | 6 | 6 | 0.97 | 6.2 | 1.24 |
| Com. Ex. 10 | 2.20 | 4.0 | 2.4 | 28 | 63 | 0.94 | 7.0 | 1.27 |

(Spreadability Under Non-Pressurized Condition)

The toner was placed on a sheet of glossy paper (POD GLOSS COATED PAPER 128, manufactured by Oji Paper Co., Ltd.) so as to separate toner particles one by one as possible by air blowing. Next, the sheet of glossy paper on which the toner had been placed was cut into 1 cm-square pieces. Thereafter, the piece was placed on a heating device for microscope (manufactured by JAPAN HIGH TECH CO., LTD.), followed by heating from 25° C. to 100° C. at a rate of 10° C./min. During the heating, the piece was observed for melt-spreading of the toner by means of a microscope and recorded as a video. The recorded video data was captured to PC. Here, a magnification for observation was set to a magnification at which an area of 400 μm×400 μm can be observed. Images of the toner particles at 25° C. and 100° C. were analyzed by means of an image processing software to thereby calculate an area of each of the toner particle. Spreadability of the toner was determined by averaging ratios of areas of particles at 25° C. to areas of the particles at 100° C. for 100 particles.

(Log G' and Tan δ)

The toner was pressure-molded into a tablet having a diameter of 10 mm and a thickness of 1 mm. Then, the toner which had been pressure-molded into the tablet was anchored onto a parallel plate of a dynamic viscoelasticity measuring device (ARES, manufactured by TA Instruments—Waters L.L.C.), and measured for a storage modulus at 100° C. (G') and a loss modulus at 100° C. (G") under the following conditions to thereby determine log G' and tan δ (=G"/G').

Sweeping temperature: sweeping from 60° C.

Frequency: 1 Hz

Strain amount control: 0.1%

Temperature increase rate: 2.5° C./min (Degree of Crystallinity)

The degree of crystallinity CX was measured with a powder X-ray diffractometer (D8 DISCOVER, manufactured by Bruker Corporation). Specifically, a sample holder was filled with the toner, and measured with rotating under the following conditions.

Radiation source: CuKα

Output: 45 kV, 110 mA

Collimator: 300 mmf double (metal collimator)

Detector distance: 25 cm

Measurement range: 2° to 64° (2q)

Next, crystalline portions (peak) and non-crystalline portions (halo) were fitted (see NTR report No. M-1012), and the degree of crystallinity [%] was calculated from the following expression:

$$Ic/(Ic+Ia)\times 100$$

where Ic denotes integrated intensity of crystalline scattering and Ia denotes integrated intensity of non-crystalline scattering.

(Content of Ethyl Acetate)

The content of ethyl acetate was measured by means of a gas chromatograph-mass spectrometer GCMS-QP2010 (manufactured by SHIMADZU CORPORATION), a data analysis software GCMS SOLUTION (manufactured by SHIMADZU CORPORATION), and a heater PY2020D (manufactured by Frontier Laboratories Ltd.).

Sample amount: 10 mg

Heating temperature: 180° C.

Heating time: 15 min

Cryo-trapping: −190° C.

Column: ULTRA ALLOY-5, L=30 m, ID=0.25 mm, Film=0.25 μm

Temperature increase of Column: 60° C. (1 min hold), 10° C./min, 130° C., 20° C./min, 300° C. (9.5 min hold)

Pressure of carrier gas: 56.7 kPa (constant)

Flow rate of column: 1.0 mL/min

Ionization method: EI method (70 eV)

Mass ratio: m/z=29 to 700

(Average Circularity)

The average circularity of the toner was measured using a flow-type particle image analyzer (FPIA-2100, manufactured by Sysmex Co.) and an analysis software (FPIA-2100 Data Processing Program for FPIA Version 00-10, manufactured by Sysmex Co.). Specifically, a 100 mL glass beaker was charged with 0.1 mL to 0.5 mL of a 10% by mass surfactant (NEOGEN SC-A, which is an alkylbenzene sulfonate, manufactured by Dai-ichi Kogyo Seiyaku Co., Ltd.) and 0.1 g to 0.5 g of the toner, followed by stirring with a microspatula. Then, 80 mL of ion-exchanged water was added thereto. The resultant was dispersed for 3 min by means of an ultrasonic wave disperser (manufactured by Honda Electronics Co.). The average circularity of the toner was measured until the number of the toner particles per microliter of the resultant dispersion liquid reached 5,000 to 15,000.

(Weight Average Particle Diameter $D_4$ and Number Average Particle Diameter Dn)

The toner was measured for the weight average particle diameter $D_4$ and the number average particle diameter Dn by means of COULTER MULTISIZER II (manufactured by Beckman Coulter, Inc.). Specifically, 0.1 mL to 5 mL of a nonionic surfactant (polyoxyethylene alkyl ether) and 2 mg to 20 mg of a sample were added to 100 mL to 150 mL of an electrolyte solution ISOTON-II (manufactured by Beckman Coulter, Inc.), followed by dispersing with an ultrasonic wave disperser (manufactured by Honda Electronics Co.) for 1 min to 3 min. The resultant dispersion liquid was measured for the weight average particle diameter $D_4$ and the number average particle diameter Dn using an aperture of 100 μm. Note that, in this measurement, the following 13 channels were used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive). That is, particles having the particle diameter of 2.00 μm or more but less than 40.30 μm were targets to be measured.

Then, two-component developers were produced using toners of Examples 1 to 6 and Comparative Examples 1 to 4.

[Production of Carrier]

Toluene (450 parts by mass), a silicone resin (SR2400, manufactured by Dow Corning Toray Co., Ltd., nonvolatile component: 50% by mass) (450 parts by mass), aminosilane (SH6020, manufactured by Dow Corning Toray Co., Ltd.) (10 parts by mass) and carbon black (10 parts by mass) were dispersed with a stirrer for 10 min to obtain a coating liquid for a protective layer.

A coating device was charged with the resultant coating liquid for a protective layer and 5,000 parts by mass of Mn ferrite particles having the weight average particle diameter of 35 μm to coat the Mn ferrite particles with the coating liquid for a protective layer. The coating device was provided with a rotational bottom plate disk and a stirring blade in a fluid bed, and was configured to perform coating while forming a rotational flow. Then, the resultant was baked at 250° C. for 2 hours in an electric furnace to form a protective layer having an average thickness of 0.5 μm to thereby obtain a carrier.

[Production of Two-Component Developer]

The carrier (100 parts by mass) was mixed with the toner (7 parts by mass) by means of a tubular mixer in which a container was rolled to stir contents thereof to thereby obtain a two-component developer.

Then, the two-component developer was evaluated for low temperature fixability under a low temperature and low humidity environment and paper type correspondency using evaluation devices A and B. Additionally, the toners of Examples 1 to 6 and Comparative Example 1 to 4 were evaluated for flowability under a high temperature and high humidity environment.

(Evaluation Device A)

As an evaluation device A, a modified image forming apparatus (IMAGIO MP C6000, manufactured by Ricoh Company, Ltd.) in which a fixing section had been mainly modified was used. Its developing unit, transfer unit, cleaning unit, and conveyance unit were adjusted so as to give a system velocity of 0.35 m/s. Moreover, a fixing unit of the fixing section was set to have a contact pressure of a fixing medium of 40 N/cm$^2$, and fixing nip time of 40 ms. The heating temperature was set to 100° C. The fixing medium was prepared as follows. A tetrafluoroethylene-perfluoroalkylvinyl ether copolymer resin (PFA) was applied onto a surface, followed by shaping to thereby process the surface.

(Evaluation Device B)

As an evaluation device B, a modified image forming apparatus (IMAGIO MP C6000, manufactured by Ricoh Company, Ltd.) in which a fixing section had been mainly modified was used. Its developing unit, transfer unit, cleaning unit, and conveyance unit were adjusted so as to give a system velocity of 2.2 m/s. Moreover, a fixing unit of the fixing section was set to have a contact pressure of a fixing medium of 110 N/cm$^2$, and fixing nip time of 130 ms. The heating temperature was set to 110° C. The fixing medium was prepared as follows. A tetrafluoroethylene-perfluoroalkylvinyl ether copolymer resin (PFA) was applied onto a surface, followed by shaping to thereby process the surface.

(System Velocity)

One hundred sheets of A4-size paper were continuously fed in a longitudinal feeding direction (length of sheet in the feeding direction: 297 mm), and the system velocity is calculated according to the following expression: 100× 297/A (where A denotes the feeding time [s] from start to finish).

(Contact Pressure of Fixing Medium)

The contact pressure of the fixing medium was measured by means of a pressure distribution measuring device PINCH (manufactured by NITTA Corporation).

(Fixing Nip Time)

The fixing medium was measured for the linear velocity and the fixing nip width to calculate the fixing nip time.

(Low Temperature Fixability Under Low Temperature and Low Humidity Environment)

A chart having an image area rate of 5% was outputted onto 10,000 sheets of paper under a low temperature and low humidity environment of 10° C. and 15% RH. Thereafter, images were outputted while the heating temperature at a fixing unit was changed by 5° C. to thereby determine the low temperature fixability. Here, the image was formed on a sheet of FULL-COLOR PPC PAPER TYPE 6200 (manufactured by Ricoh Company, Ltd.) so that an image density was 1.2 as measured by a reflection spectral densitometer X-RITE 938 (manufactured by X-Rite Inc.). Then, image densities before and after rubbing the image for 50 times by a clock meter equipped with an ink eraser were measured to thereby calculate a fixation rate [%] according to the following expression:

(Image density after rubbing for 50 times)/(Image density before rubbing 50 times)×100

Additionally, the lower limit of the heating temperature at the fixing unit of which fixation rate was 80% or more was determined as the lower limit fixing temperature. Note that, the lower limit fixing temperature was evaluated according to the following criteria:

A: Lower limit fixing temperature was less than 100° C.

B: Lower limit fixing temperature was 100° C. or more but less than 110° C.

C: Lower limit fixing temperature was 110° C. or more but less than 130° C.

D: Lower limit fixing temperature was 130° C. or more.

(Flowability Under High Temperature and High Humidity Environment)

The flowability was evaluated by means of a powder tester model PT-N (manufactured by Hosokawa Micron Corporation) installed under a high temperature and high humidity environment of 35° C. and 80% RH. Specifically, 2.0 g of the toner was left to stand for 48 hours under the high temperature and high humidity environment of 35° C. and 80% RH. Thereafter, the toner was sieved with sieves (mesh size: 150 and 45 μm; plain-woven wire mesh; Japanese Industrial Standards Z 8801-1). An amount of the toner remaining on each of the sieves was weighed to thereby calculate the flowability [%] according to the following expression:

$$(A+0.6\times B+0.2\times C)/2.0\times 100$$

where A, B, and C denote amounts [g] of the toners remaining on the sieves with mesh sizes of 150 μm, 75 μm, and 45 μM, respectively.

Note that, the flowability was evaluated according to the following criteria:

A: Flowability was less than 10%.

B: Flowability was 10% or more but less than 20%.

C: Flowability was 20% or more but less than 30%.

D: Flowability was 30% or more.

(Paper type correspondency)

A chart having an image area rate of 5% was outputted onto 10,000 sheets of paper under an environment of 23° C. and 60% RH. Thereafter, images were outputted while the heating temperature at a fixing unit was changed by 5° C. to thereby determine the low temperature fixability. Here, the image was formed on a sheet of each of FULL-COLOR PPC PAPER TYPE 6000/70W (manufactured by Ricoh Company, Ltd.) and OK TOPCOAT N (basis weight: 79.1 g/m$^2$, manufactured by Oji Paper Co., Ltd.) so that an image density was 1.2 as measured by a reflection spectral densitometer X-RITE 938 (manufactured by X-Rite Inc.). Then, image densities before and after rubbing the image for 50 times by a clock meter equipped with an ink eraser were measured to thereby calculate a fixation rate [%] according to the following expression:

(Image density after rubbing for 50 times)/(Image density before rubbing 50 times)×100

Additionally, the lower limit of the heating temperature at the fixing unit of which fixation rate was 80% or more was determined as the lower limit fixing temperature. Note that, the lower limit fixing temperature was evaluated according to the following criteria:

A: Difference of lower limit fixing temperatures between paper types was less than 5° C.

B: Difference of lower limit fixing temperatures between paper types was 5° C. or more but less than 10° C.

C: Difference of lower limit fixing temperatures between paper types was 10° C. or more but less than 20° C.

D: Difference of lower limit fixing temperatures between paper types was 20° C. or more.

(Dot reproducibility)

A halftone chart having an image area rate of 5% was outputted under an environment of 23° C. and 60% RH, followed by being observed by an optical microscope to thereby evaluate dot reproducibility. Here, the image was formed on a sheet of OK TOPCOAT N (basis weight: 79.1 g/m$^2$, manufactured by Oji Paper Co., Ltd.). Note that, the dot reproducibility was evaluated according to the following criteria:

A: Blurring due to melting during melt-fixing was not occurred.

B: Blurring due to melting during melt-fixing was slightly occurred, but acceptable.

C: Blurring due to melting during melt-fixing was clearly occurred, and unacceptable.

(Developing Stability)

A chart having an image area rate of 5% was outputted onto 50,000 sheets of paper under an environment of 23° C. and 60% RH. Thereafter, toner scattering around a developed portion was visually observed to thereby evaluate developing stability. Note that, the developing stability was evaluated according to the following criteria:

A: Toner scattering was not occurred.

B: Toner scattering was slightly occurred, but acceptable.

C: Toner scattering was clearly occurred, and unacceptable.

Tables 2-1 and 2-2 show evaluation results of the toners of Examples 1 to 6 and Comparative Examples 1 to 4 for the low temperature fixability under a low temperature and low humidity environment, the flowability under a high temperature and high humidity environment, the paper type correspondency, the dot reproducibility, and the developing stability.

TABLE 2-1

| | Low temperature fixability under low temperature and low humidity environment | | Flowability under high temperature and high humidity environment | Paper type correspondency | |
|---|---|---|---|---|---|
| | Evaluation device A | Evaluation device B | | Evaluation device A | Evaluation device B |
| Ex. 1 | B | C | B | B | B |
| Ex. 2 | A | — | C | A | — |
| Ex. 3 | A | — | C | B | — |
| Ex. 4 | C | — | B | A | — |
| Ex. 5 | C | — | A | C | — |
| Ex. 6 | B | — | C | A | — |
| Com. Ex. 1 | B | — | D | A | — |
| Com. Ex. 2 | C | — | D | D | — |
| Com. Ex. 3 | D | — | B | A | — |
| Com. Ex. 4 | D | — | A | D | — |
| Com. Ex. 5 | C | — | B | D | — |
| Com. Ex. 6 | B | — | D | B | — |
| Com. Ex. 7 | A | — | D | B | — |
| Com. Ex. 8 | D | — | A | B | — |
| Com. Ex. 9 | C | — | B | D | — |
| Com. Ex. 10 | B | — | D | B | — |

TABLE 2-2

| | Dot reproducibility | | Developing stability | |
|---|---|---|---|---|
| | Evaluation device A | Evaluation device B | Evaluation device A | Evaluation device B |
| Ex. 1 | A | B | A | B |
| Ex. 2 | B | — | B | — |
| Ex. 3 | A | — | A | — |
| Ex. 4 | B | — | B | — |
| Ex. 5 | A | — | A | — |
| Ex. 6 | B | — | A | — |
| Com. Ex. 1 | C | — | C | — |
| Com. Ex. 2 | A | — | B | — |
| Com. Ex. 3 | C | — | C | — |
| Com. Ex. 4 | A | — | A | — |
| Com. Ex. 5 | B | — | B | — |
| Com. Ex. 6 | C | — | C | — |
| Com. Ex. 7 | C | — | C | — |
| Com. Ex. 8 | C | — | B | — |
| Com. Ex. 9 | B | — | B | — |
| Com. Ex. 10 | C | — | C | — |

As can be seen from Tables 2-1 and 2-2, the toners of Examples 1 to 6 are excellent in the low temperature fixability under a low temperature and low humidity environment, the flowability under a high temperature and high humidity environment, the paper type correspondency, the dot reproducibility, and the developing stability.

In contrast, the toner of Comparative Example 1 had the spreadability under a non-pressurized condition of 2.60, log G' of 3.9, tan δ of 2.3, and a content of ethyl acetate of 31 μg/g, which indicates that the flowability under a high temperature and high humidity environment, the dot reproducibility, and the developing stability are poor.

The toner of Comparative Example 2 had the spreadability under a non-pressurized condition of 1.10, log G' of 3.8, and tan δ of 2.4, which indicates that the flowability under a high temperature and high humidity environment, and the paper type correspondency are poor.

The toner of Comparative Example 3 had the spreadability under a non-pressurized condition of 2.70, log G' of 5.1, tan δ of 1.0, and a content of ethyl acetate of 49 μg/g, which indicates that the flowability under a high temperature and high humidity environment, the dot reproducibility, and the developing stability are poor.

The toner of Comparative Example 4 had the spreadability under a non-pressurized condition of 1.10, log G' of 5.2, and tan δ of 0.9, which indicates that the flowability under a high temperature and high humidity environment, and the paper type correspondency are poor.

Embodiments of the present invention are as follows.

<1> A toner, including:

a colorant; and a binder resin, wherein a spreadability of the toner under a non-pressurized condition is 1.20 to 2.50, wherein a common logarithm of a storage modulus at 100° C. (G') of the toner is 4.0 [log Pa] to 5.0 [log Pa], and wherein a ratio of a loss modulus at 100° C. (G") of the toner to the storage modulus at 100° C. (G'), which is expressed by G"/G' equal to tan δ, is 1.1 to 2.2.

<2> The toner according to <1>, wherein a degree of crystallinity of the toner is 10% or more.

<3> The toner according to <1> or <2>, further including ethyl acetate, wherein a content of the ethyl acetate is 1 μg/g to 30 μg/g.

<4> The toner according to any one of <1> to <3>, wherein the toner includes toner base particles each of which includes the colorant and the binder resin, and wherein each of the toner base particles has a core-shell structure.

<5> The toner according to any one of <1> to <4>, wherein the binder resin includes polyester.

<6> The toner according to <5>, wherein the polyester includes a urea-modified polyester.

<7> The toner according to <5> or <6>, wherein the polyester includes a crystalline polyester.

<8> The toner according to any one of <1> to <7>, wherein an average circularity of the toner is 0.93 to 0.99.

<9> The toner according to any one of <1> to <8>, wherein a weight average particle diameter of the toner is 2 μm to 7 μm, and wherein a ratio of the weight average particle diameter to a number average particle diameter of the toner is 1.00 to 1.25.

<10> The toner according to any one of <1> to <9>, wherein the toner is produced by dispersing a solution or dispersion liquid into an aqueous medium in which a vinyl-based resin is dispersed, and wherein the solution or dispersion liquid is produced by dissolving or dispersing a composition containing an isocyanate group-containing polyester prepolymer, amines, polyester, the colorant, and a releasing agent into an organic solvent.

<11> An image forming apparatus, including:

a photoconductor;

a charging unit configured to charge the photoconductor;

an exposing unit configured to expose the photoconductor charged to light, to thereby form an electrostatic latent image;

a developing unit containing the toner according to any one of <1> to <10>, and configured to develop the electrostatic latent image which has been formed on the photoconductor with the toner, to thereby form a toner image;

a transfer unit configured to transfer the toner image which has been formed on the photoconductor onto a recording medium; and a fixing unit configured to fix the toner image which has been transferred onto the recording medium.

<12> A process cartridge, including:

a photoconductor; and a developing unit containing the toner according to any one of <1> to <10>, and configured to develop the electrostatic latent image which has been formed on the photoconductor with the toner, wherein the photoconductor and the developing unit are integrally supported, and wherein the process cartridge is attachable to and detachable from a main body of an image forming apparatus.

<13> A developer, including:

the toner according to any one of <1> to <10>; and a carrier.

REFERENCE SIGNS LIST

10 Intermediate transfer member
21 Exposing device
22 Secondary transfer device
25 Fixing device
40 Photoconductor
60 Charging device
61 Developing device
62 Primary transfer device
63 Cleaning device
64 Charge-eliminating device

The invention claimed is:

1. A toner, comprising:

toner base particles having a core-shell structure and comprising:

a colorant; and a binder resin, wherein an average value of ratios of particle areas at 100° C. to particle areas at 25° C. when the toner is heated from 25° C. to 100° C. at a rate of 10° C./min under a non-pressurized condition is 1.20 to 2.50, wherein a common logarithm of a storage modulus at 100° C. (G') of the toner is 4.0 [log Pa] to 5.0 [log Pa], and wherein a ratio of a loss modulus at 100° C. (G") of the toner to the storage modulus at 100° C. (G') of the toner, which is expressed by G"/G' equal to tan δ, is 1.1 to 2.2.

2. The toner according to claim 1, wherein a degree of crystallinity of the toner is 10% or more.

3. The toner according to claim 1, further comprising ethyl acetate, wherein a content of the ethyl acetate is 1 μg/g to 30 μg/g.

4. The toner according to claim 1, wherein the binder resin comprises polyester.

5. The toner according to claim 4, wherein the polyester comprises a urea-modified polyester.

6. The toner according to claim 4, wherein the polyester comprises a crystalline polyester.

7. The toner according to claim 1, wherein an average circularity of the toner is 0.93 to 0.99.

8. The toner according to claim 1, wherein a weight average particle diameter of the toner is 2 μm to 7 μm, and wherein a ratio of the weight average particle diameter to a number average particle diameter of the toner is 1.00 to 1.25.

9. The toner according to claim 1, wherein the toner is produced by dispersing a solution or dispersion liquid into an aqueous medium in which a vinyl-based resin is dispersed, and wherein the solution or dispersion liquid is produced by dissolving or dispersing a composition containing an isocyanate group-containing polyester prepolymer, amines, polyester, the colorant, and a releasing agent into an organic solvent.

10. An image forming apparatus, comprising:

a photoconductor;

a charging unit configured to charge the photoconductor;

an exposing unit configured to expose the photoconductor charged to light, to thereby form an electrostatic latent image;

a developing unit containing the toner according to claim 1, and configured to develop the electrostatic latent image which has been formed on the photoconductor with the toner, to thereby form a toner image;

a transfer unit configured to transfer the toner image which has been formed on the photoconductor onto a recording medium; and a fixing unit configured to fix the toner image which has been transferred onto the recording medium.

11. A process cartridge, comprising:

a photoconductor; and a developing unit containing the toner according to claim 1, and configured to develop the electrostatic latent image which has been formed on the photoconductor with the toner;

wherein the photoconductor and the developing unit are integrally supported, and wherein the process cartridge is attachable to and detachable from a main body of an image forming apparatus.

12. A developer, comprising:

the toner according to claim 1; and a carrier.

13. The toner according to claim 1, wherein an average value of ratios of particle areas at 100° C. to particle areas at 25° C. when the toner is heated from 25° C. to 100° C. at a rate of 10° C./min under a non-pressurized condition is 1.30 to 2.20.

14. The toner according to claim 1, further comprising ethyl acetate, wherein a content of the ethyl acetate is 5 μg/g to 17 μg/g.

15. The toner according to claim 1, wherein a degree of crystallinity of the toner is 30% or more.

16. The toner according to claim 1, wherein:

an average circularity of the toner is 0.93 to 0.99;

a weight average particle diameter of the toner is 2 μm to 7 μm;

a ratio of the weight average particle diameter to a number average particle diameter of the toner is 1.00 to 1.25;

an average value of ratios of particle areas at 100° C. to particle areas at 25° C. when the toner is heated from 25° C. to 100° C. at a rate of 10° C./min under a non-pressurized condition is 1.30 to 2.20; and a degree of crystallinity of the toner is 30% or more.

17. An image forming apparatus, comprising:

a photoconductor;

a charging unit configured to charge the photoconductor;

an exposing unit configured to expose the photoconductor charged to light, to thereby form an electrostatic latent image;

a developing unit containing the toner according to claim 16, and configured to develop the electrostatic latent image which has been formed on the photoconductor with the toner, to thereby form a toner image;

a transfer unit configured to transfer the toner image which has been formed on the photoconductor onto a recording medium; and a fixing unit configured to fix the toner image which has been transferred onto the recording medium.

18. A process cartridge, comprising:

a photoconductor; and a developing unit containing the toner according to claim 16, and configured to develop the electrostatic latent image which has been formed on the photoconductor with the toner;

wherein the photoconductor and the developing unit are integrally supported, and wherein the process cartridge is attachable to and detachable from a main body of an image forming apparatus.

19. A developer, comprising:

the toner according to claim 16; and a carrier.

* * * * *